US009604777B2

(12) United States Patent
Wakita et al.

(10) Patent No.: US 9,604,777 B2
(45) Date of Patent: Mar. 28, 2017

(54) WATER STORAGE STRUCTURE

(71) Applicant: Panasonic Corporation, Osaka (JP)

(72) Inventors: Yumi Wakita, Nara (JP); Osamu Yamada, Nara (JP); Norihisa Mino, Osaka (JP); Akira Taomoto, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 694 days.

(21) Appl. No.: 14/067,221

(22) Filed: Oct. 30, 2013

(65) Prior Publication Data

US 2014/0048542 A1 Feb. 20, 2014

Related U.S. Application Data

(63) Continuation of application No. PCT/JP2012/007795, filed on Dec. 5, 2012.

(30) Foreign Application Priority Data

Dec. 7, 2011 (JP) ..... 2011-267974

(51) Int. Cl.
*E01C 3/06* (2006.01)
*B65D 88/02* (2006.01)
(Continued)

(52) U.S. Cl.
CPC ..... *B65D 88/02* (2013.01); *E01C 3/003* (2013.01); *E01C 3/06* (2013.01); *E01C 11/225* (2013.01); *E03F 1/002* (2013.01)

(58) Field of Classification Search
CPC . B65D 88/02; E01C 3/003; E01C 3/06; E01C 11/225; E01C 11/226; E03F 1/002
(Continued)

(56) References Cited

U.S. PATENT DOCUMENTS 3,870,422 A * 3/1975 Medico, Jr. ..... E01C 3/00 404/17
5,026,207 A * 6/1991 Heath ..... E02B 11/00 405/229
(Continued)

FOREIGN PATENT DOCUMENTS

JP 7-238503 9/1995
JP 2003-147715 5/2003
(Continued)

OTHER PUBLICATIONS

English translation of the International Preliminary Report on Patentability issued Jun. 16, 2014 in International (PCT) Application No. PCT/JP2012/007795.
(Continued)

*Primary Examiner* — Brent W Herring
(74) *Attorney, Agent, or Firm* — Wenderoth, Lind & Ponack, L.L.P.

(57) ABSTRACT

A water storage structure includes an impermeable layer including a plurality of hydrophobic particles, a water retentive layer provided on the impermeable layer and capable of holding a predetermined volume of liquid, and a pavement layer provided on the water retentive layer and including a tube penetrating from a first surface to a second surface.

17 Claims, 14 Drawing Sheets

(51) Int. Cl.
*E03F 1/00* (2006.01)
*E01C 11/22* (2006.01)
*E01C 3/00* (2006.01)

(58) Field of Classification Search
USPC ..... 404/36–38, 50
See application file for complete search history.

(56) References Cited

U.S. PATENT DOCUMENTS 5,520,480 A 5/1996 Ohsaki et al.
6,146,051 A * 11/2000 Pratt ..... E01C 3/06 404/2
7,870,691 B2 * 1/2011 Williams ..... E04D 11/002 405/20
8,104,990 B2 * 1/2012 Lowe ..... E01C 3/003 404/17
8,323,485 B2 * 12/2012 Blundell ..... E03F 1/002 210/163
8,834,065 B2 * 9/2014 Hart ..... E01C 3/06 405/36
8,944,720 B2 * 2/2015 Nolt ..... B65G 5/00 405/54
9,328,871 B2 * 5/2016 Nolt ..... B65G 5/00
2009/0129864 A1 * 5/2009 Flynn ..... E01C 11/225 404/101
2010/0139184 A1 * 6/2010 Williams ..... E04D 11/002 52/173.3
2011/0229262 A1 9/2011 Shibata et al.
2013/0011195 A1 * 1/2013 Bower ..... C03C 12/00 404/31

FOREIGN PATENT DOCUMENTS

JP 3450489 7/2003
JP 2003239207 A * 8/2003
JP 2004132143 A * 4/2004
JP 2008008040 A * 1/2008
JP 4178525 9/2008
JP 2009-68240 4/2009
JP 2010-37896 2/2010
WO 2010/061905 6/2010

OTHER PUBLICATIONS

International Search Report (ISR) issued Mar. 12, 2013 in International (PCT) Application No. PCT/JP2012/007795.

* cited by examiner

Fig.7
| TYPE OF WATER REPELLENT PARTICLE LAYER | WATER REPELLENT GLASS | WATER REPELLENT TOYOURA SAND | WATER REPELLENT SEA SAND | TOYOURA SAND WITH NO WATER REPELLENCY |
|---|---|---|---|---|
| PARTICLE DIAMETER RANGE | 0.03mm | 0.1mm ~ 0.4mm | 0.425mm ~ 0.85mm | 0.1mm ~ 0.4mm |
| CRITICAL WATER LEVEL | 100cm · $H_2O$ | 21cm · $H_2O$ | 10cm · $H_2O$ | 2cm · $H_2O$ |
Fig.8A
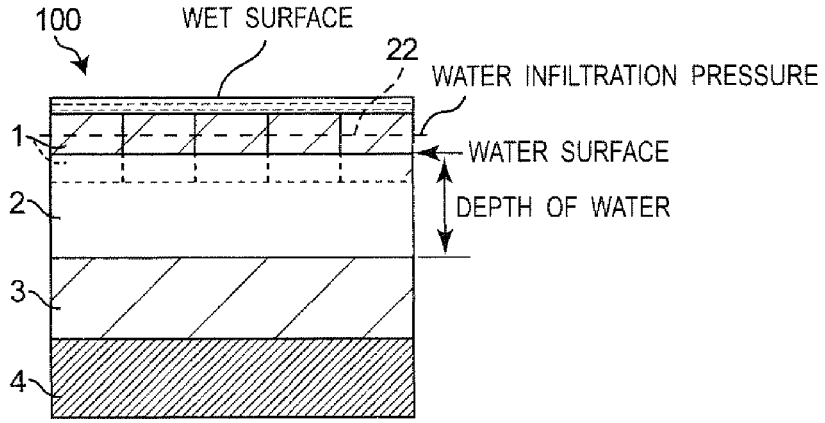
Fig.8B
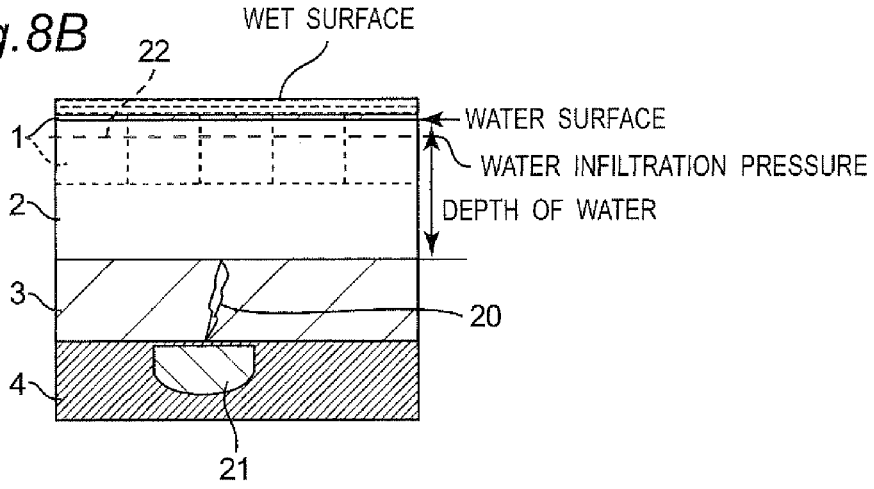

Fig.8F
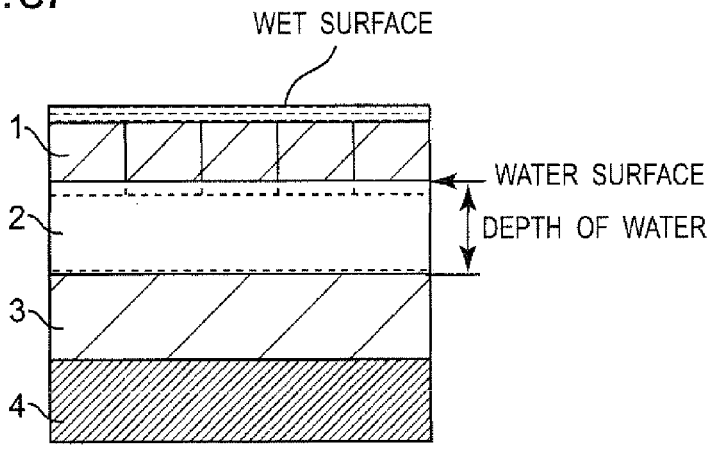
Fig.9
| MIXTURE RATIO (WITH NO WATER REPELLENT TREATMENT : WITH WATER REPELLENT TREATMENT) | 1:1 | 1:3 | 1:5 | 1:7 | 0:1 (ONLY WATER REPELLENT SAND) |
|---|---|---|---|---|---|
| CRITICAL WATER LEVEL | 2cm · $H_2O$ | 2cm · $H_2O$ | 5cm · $H_2O$ | 8cm · $H_2O$ | 10cm · $H_2O$ |
Fig.10
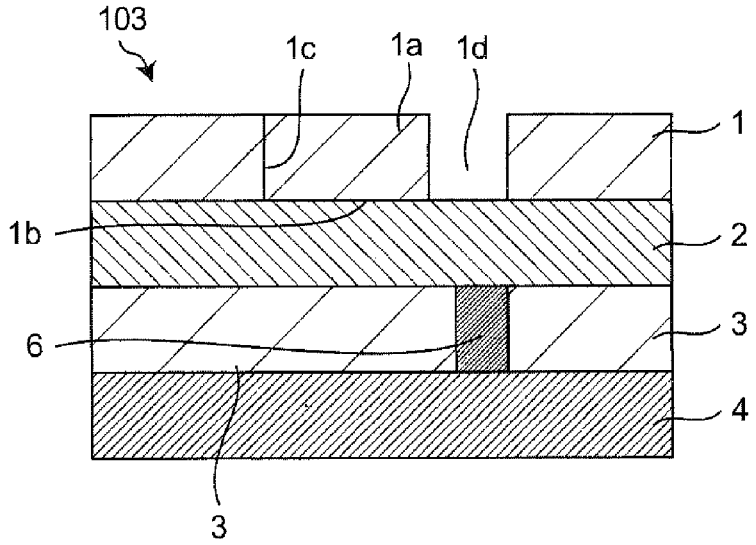

*Fig.14F*
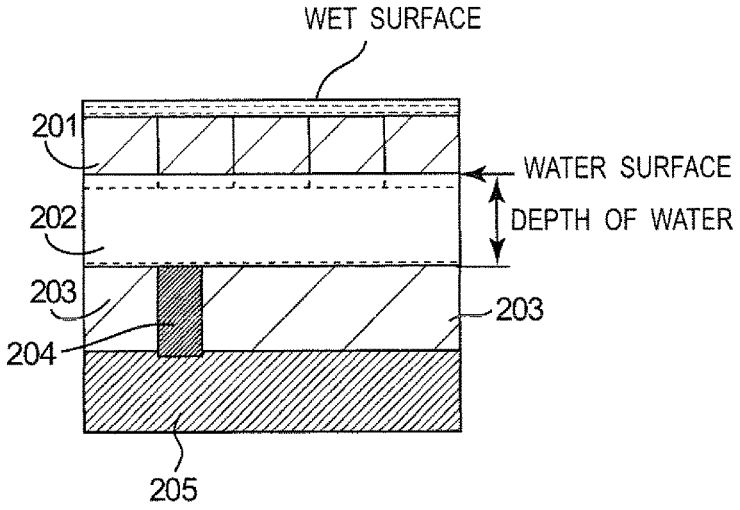
*Fig.15*
| TOTAL NUMBER OF TIMES OF WATER SUPPLY | 0 | 1 | 10 | 25 | 40 | 50 |
|---|---|---|---|---|---|---|
| WATER INFILTRATION PRESSURE | 100mm | 97mm | 96mm | 98mm | 97mm | 97mm |
*Fig.16*
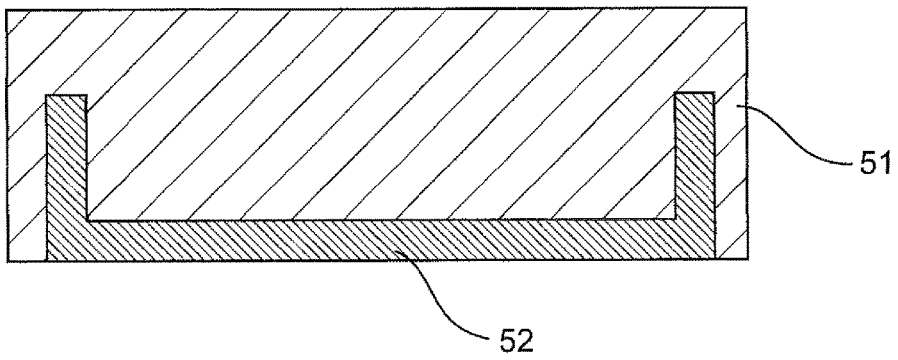

WATER STORAGE STRUCTURE

CROSS-REFERENCE TO RELATED APPLICATIONS

This is a continuation application of International Application No. PCT/JP2012/007795, with an international filing date of Dec. 5, 2012, which claims priority of Japanese Patent Application No. 2011-267974 filed on Dec. 7, 2011, the content of which is incorporated herein by reference.

TECHNICAL FIELD

The technical field relates to a water storage structure for storing water therein.

BACKGROUND ART

There has been recently proposed a pavement structure having a function of suppressing a surface temperature of a road, a sidewalk, or a roof of a building, in order to reduce the heat island effect. Patent Literature 1 proposes a permeable block and a permeable pavement each of which is capable of preventing rise in temperature of a pavement surface. FIG. 16 shows a structure of the permeable block according to Patent Literature 1. The permeable block includes a permeable body 51 that is made of a permeable material and has a porous shape, and a storage container 52 that is buried in the permeable body 51 and stores water. Rainwater or the like passes through the permeable body 51 and is then held in the storage container 52. The water thus held keeps the surface of the block wet to prevent rise in temperature.

Patent Literature 2 discloses a developed ground structure including a permeable layer, an impermeable layer surrounding the permeable layer, and a drain pipe that penetrates the impermeable layer and connects the permeable layer and an outer end of the permeable layer.

CITATION LIST

Patent Literatures

Patent Literature 1: JP 4178525 B1 (JP 2006-291706 A)
Patent Literature 2: JP 3450489 B1

SUMMARY OF THE INVENTION

In the configuration according to Patent Literature 1, rainwater is once held in the storage container and the water thus held is evaporated with use of heat in the block, so that the atmosphere temperature is decreased. Water is evaporated mainly at the surface of the water in the storage container that is buried in the block. The cooling efficiency at and around the ground surface deteriorates if the storage container is located deep and far from the ground surface. When the block is reduced in height and the storage container is located near the surface in order to solve this problem, the surface can be kept wet whereas drainage performance deteriorates. In this case, if excessive water is supplied by heavy rain or the like, water overflows from the pavement surface.

Meanwhile, Patent Literature 2 discloses draining water in the permeable layer through the drain pipe so as to adjust the amount of water stored in the permeable layer. In order to prevent water from overflowing from the pavement surface when excessive water is supplied by heavy rain or the like, the amount of water stored in the permeable layer is adjusted to need to open or close a gate valve provided to the drain pipe. In this case, the structure is complicated, troublesome operation is required, and the cost is increased.

The structure according to each of Patent Literatures 1 and 2 makes it difficult to cool the surface with efficient use of stored water that is limited in amount as well as appropriately drain water with reduction in amount of overflowing water when a large amount of water is supplied.

One non-limiting and exemplary embodiment provides a water storage structure that is capable of cooling a surface with efficient use of stored water limited in amount as well as appropriately draining water with reduction in amount of overflowing water when a large amount of water is supplied.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

In one general aspect, the techniques disclosed here feature: A water storage structure comprising:

an impermeable layer including a plurality of hydrophobic particles;

a water retentive layer provided on the impermeable layer and capable of holding a predetermined volume of liquid; and a pavement layer provided on the water retentive layer and including a tube penetrating from a first surface to a second surface, wherein the impermeable layer has a water infiltration pressure smaller than a water pressure corresponding to a thickness of the pavement layer and thickness of the water retentive layer.

These general and specific aspects may be implemented using a system, a method, and any combination of systems and methods.

According to the aspect of the present disclosure, the surface can be cooled with efficient use of a limited amount of water that is stored, and water can be drained appropriately with reduction in amount of water overflowing on the surface when a large amount of water is supplied.

BRIEF DESCRIPTION OF THE DRAWINGS

These and other aspects and features of the present disclosure are clarified in the following description in connection with the embodiments depicted in the accompanying drawings. In these drawings.

FIG. 7 is a chart indicating the relationship between the particle diameter of the water repellent sand and the water infiltration pressure in the first embodiment;

FIG. 8A is a longitudinal sectional view showing a flow of water in the water storage structure according to the first embodiment;

FIG. 8B is a longitudinal sectional view showing a flow of water in the water storage structure according to the first embodiment;

FIG. 8F is a longitudinal sectional view showing a flow of water in the water storage structure according to the first embodiment;

FIG. 9 is a chart indicating the relationship between the mixture ratio of water repellent sand to ordinary sand and the water infiltration pressure in the first embodiment;

FIG. 10 is a longitudinal sectional view of a water storage structure including a drain hole portion according to the first embodiment;

FIG. 14F is a longitudinal sectional view showing a flow of water in the water storage structure according to the second embodiment;

FIG. 15 is a view of a table indicating change in water infiltration pressure obtained by repetitively performing trial in which water having a pressure equal to or more than the water infiltration pressure is supplied to a water repellent sand layer including sea sand processed by water repellent treatment so as to pass through the water repellent sand layer, the water repellent sand layer is then dried until sand that has allowed water to pass therethrough gets dried, and water infiltration pressure of the dried water repellent sand layer is measured; and FIG. 16 is a view showing a conventional art according to Patent Literature 1.

DETAILED DESCRIPTION

Figure 1:
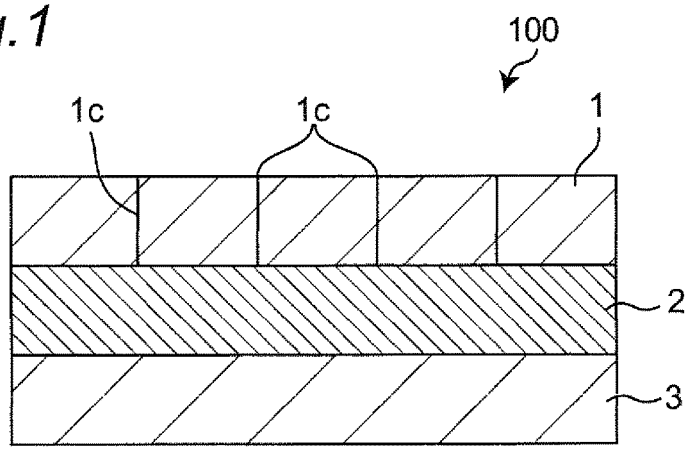
FIG. 1 is a longitudinal sectional view of a water storage structure according to a first embodiment.

Before proceeding with the description of the present disclosure, it is noted that the same components are denoted by the same reference signs respectively in the accompanying drawings.

Prior to the detailed description of the embodiments of the present disclosure with reference to the drawings, various aspects of the present disclosure are recited.

Examples of the disclosed technique are as follows.

1st aspect: A water storage structure comprising:

an impermeable layer including a plurality of hydrophobic particles;

a water retentive layer provided on the impermeable layer and capable of holding a predetermined volume of liquid; and a pavement layer provided on the water retentive layer and including a tube penetrating from a first surface to a second surface, wherein the impermeable layer has a water infiltration pressure smaller than a water pressure corresponding to a thickness of the pavement layer and thickness of the water retentive layer.

According to this aspect, the surface can be cooled with efficient use of the stored water that is limited in amount, and water can be drained appropriately with reduction in amount of water overflowing on the surface when a large amount of water is supplied.

2nd aspect: The water storage structure according to claim 1, wherein the hydrophobic particles have surfaces processed by water repellent treatment with a material of a chlorosilane system or a material of an alkoxysilane system.

According to this aspect, in addition to the effects obtained by the first aspect, the water repellent treatment with use of this material enables applying water repellent treatment to surfaces of a large amount of hydrophobic particles with the material of a small amount (e.g. surfaces of one ton of sand can be processed by water repellent treatment with use of 100 g of the material), thereby facilitating delivery of the material and the like.

3rd aspect: The water storage structure according to claim 1, wherein the water retentive layer includes an aggregation of hydrophilic particles or particles having surfaces covered with a hydrophilic material, and has a gap between the adjacent particles.

According to this aspect, in addition to the first aspect, water retentive soil can be easily prepared with use of on-site soil with no need to bring a specific material for the water retentive layer (because soil or sand typically has hydrophilicity).

4th aspect: The water storage structure according to claim 1, further comprising:

a drain hole portion that is equal in thickness to the impermeable layer and includes a water repellent sand layer having water infiltration pressure lower than that of the impermeable layer and having a thickness equal to that of the impermeable layer.

According to this aspect, in addition to the effects obtained by the first aspect, when the supplied water has a constant amount or more and needs to be drained, water is always drained limitedly at the drain hole portion in the structure of the fourth aspect, unlike the first aspect in which water is drained from an arbitrary location in the impermeable layer. It is thus possible efficiently use the structure by applying maintenance work for storing water again after drainage only to the drain hole portion with no need to apply to the entire impermeable layer.

5th aspect: The water storage structure according to any one of the first to fourth aspects, wherein the pavement layer is provided therein with gaps continuously connected to each other and has a function of absorbing water from a bottom surface to a top surface of the pavement layer.

According to this aspect, in addition to the effects obtained by the first aspect, water can be easily evaporated even when a small amount of water is stored.

6. The water storage structure according to any one of the first to fourth aspects, wherein the tube of the pavement layer causes liquid to be conveyed by a capillary phenomenon.

According to this aspect, in addition to the effects obtained by the first aspect, it is possible to ensure the effects of the first aspect with no need to provide a pavement layer with any special water absorbing arrangement.

Embodiments are described below with reference to the drawings.

(First Embodiment)

FIG. 1 shows a configuration of a water storage structure (water storage system) 100 according to the first embodiment.

The water storage structure 100 includes a pavement layer 1, a water retentive layer 2, and an impermeable layer 3. Each of these constituent elements is described below. The water storage structure 100 stores liquid.

In the present Description, the "liquid" includes water and water containing a small amount of airborne particles in the atmosphere such as aerosol, soil, or the like. Examples of the liquid include rainwater.

<Pavement Layer 1>

The pavement layer 1 is provided on the water retentive layer 2. The pavement layer 1 has a first surface 1*a* in contact with an outer space, and a second surface 1*b* in contact with the water retentive layer 2.

The pavement layer 1 has tubes 1*c* each of which has a minute inner diameter and penetrates from the first surface 1*a* to the second surface 1*b*. The tubes 1*c* in the pavement layer 1 each have a function of conveying liquid to the first surface 1*a*. The tubes 1*c* in the pavement layer 1 convey liquid through the so-called capillary phenomenon.

A pavement material for the pavement layer 1 is a block obtained by solidifying sand or gravel, concrete, bricks, or asphalt.

The inner diameter of each of the tubes 1*c* in the pavement layer 1 is dependent on the thickness or the like of the pavement layer 1 and has a size within a predetermined range.

The tubes is in the pavement layer 1 each have an inner diameter "r" determined by $h=2T\cos\theta/\rho gr$ . . . (Equation 1). In this Equation, reference sign "h" denotes the height (m) increased by rise in liquid level of the liquid in the tube 1*c*. Reference sign "T" denotes the surface tension (N/m) at liquid surface. Reference sign "θ" denotes the contact angle of the liquid surface. Reference sign "ρ" denotes the density ($kg/m^3$) of the liquid. Reference sign "g" denotes the gravitational acceleration ($m/s^2$). Reference sign "r" denotes the inner diameter (m) of the tube lc. The tubes is in the pavement layer 1 each have such an inner diameter "r" that the height (h) increased by rise in liquid level is larger than the thickness of the pavement layer 1.

More specifically, the inner diameter "r" of each of the tubes 1*c* in the pavement layer 1 is smaller than first water infiltration pressure (threshold) so that the effect of rise in liquid level is larger than the thickness of the pavement layer 1. Furthermore, the inner diameter "r" of each of the tubes is in the pavement layer 1 is larger than second water infiltration pressure (threshold) that is smaller than a size at which liquid can pass through. The predetermined range corresponds to a range larger than the second threshold and smaller than the first threshold.

Described is a method of checking whether or not the pavement layer 1 has the function of conveying liquid from the second surface 1*b* to the first surface 1*a*. The second surface 1*b* of the dried pavement layer 1 is placed on a wet object. If the first surface 1*a* of the pavement layer 1 is wet after a predetermined period of time, it can be confirmed that the pavement layer 1 has the function of conveying liquid from the second surface 1*b* to the first surface 1*a*.

An example of the wet object is the water retentive layer 2 containing liquid to be mentioned later. For example, a substance as a possible material for the pavement layer 1 is placed on the water retentive layer 2 containing the liquid to be mentioned later. After 30 minutes, a facial tissue is placed on the substance as the possible material for the pavement layer 1. When it is observed that the facial tissue is wet, the substance as the possible material for the pavement layer 1 can be confirmed to have the function of conveying liquid from the second surface 1*b* to the first surface 1*a*.

The pavement layer 1 can be formed by an aggregation of a plurality of particles or the like. It can be regarded that the inner diameter "r" of each of the tubes 1*c* in the pavement layer 1 is dependent on the diameters of the particles. Each of the tubes is in the pavement layer 1 corresponds to a gap between the adjacent particles. It is regarded that the inner diameter "r" of each of the tubes 1*c* in the pavement layer 1 is determined by the diameters of the particles, the state of contact between the adjacent particles, and the like. It is noted that the layer configured by the aggregation of the particles includes a sufficiently large number of particles in contact with each other in various states. The states of contact between the adjacent particles do not influence largely the inner diameter "r" of each of the tubes 1*c*. Accordingly, it can be regarded that the inner diameter "r"

of each of the tubes is in the pavement layer 1 is dependent on the diameters of the particles.

In a case where the pavement layer 1 is formed by the aggregation of the particles including sand or gravel and the liquid is water, capillary tubes in the pavement layer 1 each have a diameter dependent on the diameters of the particles.

The pavement layer 1 can be formed by the aggregation of the particles having diameters of 0.3 mm or less, for example. Alternatively, the pavement layer 1 can be formed by the aggregation of the particles having diameters equal to or more than 0.005 mm, for example.

The particles include gravel, sand, silt, and clay. The gravel includes particles each of which has a diameter larger than 2 mm and equal to or less than 75 mm. The sand includes particles each of which has a diameter larger than 0.075 mm and equal to or less than 2 mm. The silt includes particles each of which has a diameter larger than 0.005 mm and equal to or less than 0.075 mm. The clay includes particles each of which has a diameter of 0.005 mm or less.

The pavement layer 1 formed by sand has a permeability higher than that of the pavement layer 1 formed by silt or clay. For example, the pavement layer 1 formed by sand.

A pavement layer of 6 cm thick can be formed by particles having diameters of 0.005 mm or more and 0.3 mm or less, for example. As clarified in the Equation 1, the thicker the pavement layer 1 is, the larger the particles forming the pavement layer 1 can be.

It was checked whether or not a possible material for the pavement layer 1 actually has a desired function of the pavement layer 1. The possible material is formed by fine sand of particles having diameters from 0.005 mm to 0.3 mm and is 6 cm thick. Toyoura sand having particles of diameters from 0.1 mm to 0.4 mm was saturated with water and the possible material for the pavement layer 1 was placed thereon. After 30 minutes, a facial tissue was placed on the possible material for the pavement layer 1. It was observed that the facial tissue was wet. Consequently, the possible material for the pavement layer 1, which is formed by fine sand of particles having diameters from 0.005 mm to 0.3 mm and is 6 cm thick, is regarded as being suitable for the pavement layer 1.

The pavement layer 1 conveys liquid contained in the water retentive layer 2 from the second surface 1*b* to the first surface 1*a* of the pavement layer 1 to keep the first surface 1*a* wet. Evaporation of the liquid at the first surface 1*a* of the pavement layer 1 decreases the temperature at an upper portion in the pavement layer 1, or reduces rise in temperature at the upper portion in the pavement layer 1.

Figure 2A:
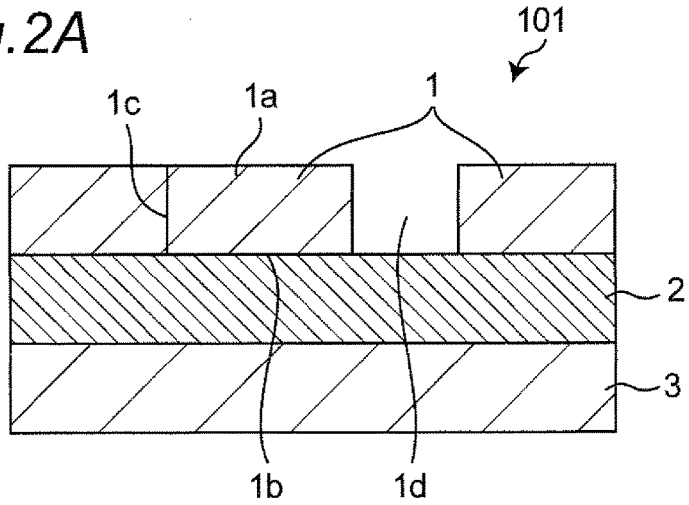
FIG. 2A is a longitudinal sectional view of a water storage structure according to a modification example of the first embodiment.

FIG. 2A is a sectional view of a water storage structure (water storage system) 101 according to a modification example of the water storage structure 100. The water storage structure 101 shown in FIG. 2A is different from the water storage structure 100 shown in FIG. 1 in the shape of the pavement layer 1.

The pavement layer 1 in the water storage structure 100 shown in FIG. 1 is entirely provided on the water retentive layer 2. In contrast, the pavement layer 1 in the water storage structure 101 shown in FIG. 2A is partially provided on the water retentive layer 2. In other words, the pavement layer 1 has a through hole 1*d* as a portion not provided with the pavement layer 1. The water storage structure 101 shown in FIG. 2A exerts effects similar to those of the water storage structure 100 shown in FIG. 1.

The through hole ld, where the pavement layer 1 is not provided on the water retentive layer 2, has an inner wall surface, and water is stored in a space surrounded with the inner wall surface of the through hole id and the water retentive layer 2. The portion storing water (the through hole id) is referred to as a water storage portion ld. The portion of the pavement layer 1 facing the water storage portion 1*d* absorbs water from the second surface 1*b* of the pavement layer 1 as well as from a side surface (the inner wall surface of the through hole 1*d*) thereof. At the water storage portion ld, the surface of water is in contact with the outside, so that the surface can be cooled more efficiently.

The configuration of the water storage structure 100 is described below again.

<Water Retentive Layer 2>

The water retentive layer 2 in the water storage structure 100 is provided between the pavement layer 1 and the impermeable layer 3. The water retentive layer 2 is formed by an aggregation of a plurality of particles. The water retentive layer 2 can be made, for example, of hydrophilic particles or particles having surfaces covered with a hydrophilic material. In the present Description, "hydrophilicity" means a property of easily combining with water or being easily mixed with water.

Examples of the hydrophilic particle are metal or ceramics. Examples of the hydrophilic particle also include soil or rocks in the nature.

Examples of the particle covered with a hydrophilic material, which covers the surface of the particle forming the water retentive layer 2, include a particle covered with polytetrafluoroethylene such as Teflon (registered trademark) or a polymer such as cupra.

There are gaps between the adjacent particles in the water retentive layer 2. The water retentive layer 2 can thus hold liquid in the gaps between the adjacent particles. In the present Description, "holding liquid" means being capable of containing and holding a predetermined volume of liquid. The predetermined volume is dependent on the hydrophilicity of the material for the water retentive layer 2 and the sizes of the gaps in the water retentive layer 2.

It is noted that the material for the water retentive layer 2 can contain a hydrophobic particle to be mentioned later, as long as the material contains at least the hydrophilic particles or the particles each having the surface covered with a hydrophilic material.

The aggregation holding water typically needs to hold 0.15 g water per volume. More specifically, the typically used aggregation holding water has a water content ratio equal to or more than 15%. The water retentive layer 2 according to the first embodiment also has a water content ratio equal to or more than 15%, for example. It is noted that a water retentive layer 2 having a water holding function smaller than 0.15 g/cm$^3$ does not necessarily fail to exert the effects related to the finding to be mentioned below.

<Impermeable Layer 3>

The impermeable layer 3 is provided under the water retentive layer 2. The impermeable layer 3 is formed by an aggregation of hydrophobic particles.

The "hydrophobic particles" includes particles each having surface processed by water repellent treatment or particles each of which is hydrophobic by itself. In the present Description, the "water repellent treatment" means providing a water repelling property.

In the present Description, "hydrophobicity" means a property of hardly combining with water or being hardly dissolved in water. For example, a hydrophobic particle has a surface that is in contact with a waterdrop at a contact angle equal to or more than 90 degrees.

Examples of the hydrophobic particle include a hydrophobic polymer.

Examples of the particle having the surface processed by water repellent treatment include a particle having a surface processed by water repellent treatment with use of a material of the chlorosilane system, a material of the alkoxysilane system, or the like.

Examples of the material of the chlorosilane system include heptadecafluoro-1,1,2,2-tetrahydrodecyltrichlorosilane and n-octadecyldimethylchlorosilane. Examples of the material of the alkoxysilane system include n-octadecyltrimethoxysilane and nonafluorohexyltriethoxysilane.

The particle processed by water repellent treatment is made of soil, a glass bead, or the like. The soil contains an inorganic substance, a colloidal inorganic substance, a coarse organic matter, or an organic substance generated through alteration due to decomposition by a microbe or the like.

If pressure of liquid applied to the impermeable layer 3 is equal to or less than the water infiltration pressure, the liquid does not pass through the impermeable layer 3. In the water storage structure 100, the pressure of water applied to the impermeable layer 3 has a maximum value corresponding to the height of each of the pavement layer 1 and the water retentive layer 2.

When liquid is supplied from the first surface 1*a* of the pavement layer 1, the liquid enters portions where there has been gas contained in the pavement layer 1 and the water retentive layer 2. The entered liquid changes the liquid level in accordance with the volume of the gas at the location. It is regarded that pressure is applied to the impermeable layer 3 in accordance with the liquid level.

If pressure of liquid applied to the impermeable layer 3 is higher than the water infiltration pressure, the liquid passes through the impermeable layer 3. The passage of liquid through the impermeable layer 3 is also referred to as "breakage". Hereinafter, the pressure at which the impermeable layer 3 starts to be broken by liquid is referred to as "infiltration pressure".

The inventors of the present application have found that the water infiltration pressure inhibiting passage of liquid is occasionally decreased after the impermeable layer 3 is once broken. Details thereof will be described later with reference to FIGS. 8A to 8F. The inventors further found that the water infiltration pressure of the impermeable layer 3 recovers if the impermeable layer 3 is dried. More specifically, in the water storage structure 100 according to the first embodiment, pressure applied to the impermeable layer 3 can be reduced after the impermeable layer 3 is broken until the water infiltration pressure of the impermeable layer 3 recovers to the original state, because the water retentive layer 2 is provided on the impermeable layer 3. The water storage structure 100 thus has time for the impermeable layer 3 to get dried.

In a case where the water storage structure does not include the water retentive layer 2, the effect of water storage deteriorates after the impermeable layer 3 is once broken as long as liquid is being supplied. The liquid supplied to the pavement layer 1 is to pass through the impermeable layer 3 in this case.

In the water storage structure 100 in which the water retentive layer 2 is provided between the pavement layer 1 and the impermeable layer 3, the water retentive layer 2 is capable of holding a predetermined volume of liquid even after the impermeable layer 3 is broken.

<Exemplary Configuration of Water Storage Structure 100>

For example, soil at a portion to be provided with the water storage structure 100 is removed partially and the water storage structure 100 is placed at the removed portion.

Figure 2B:
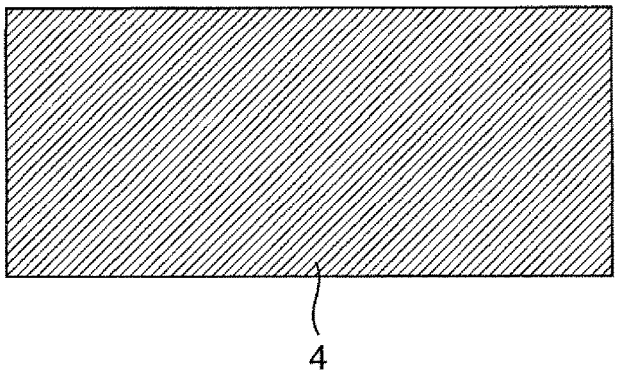
FIG. 2B is a longitudinal sectional view of on-site (local) soil.
Figure 2C:
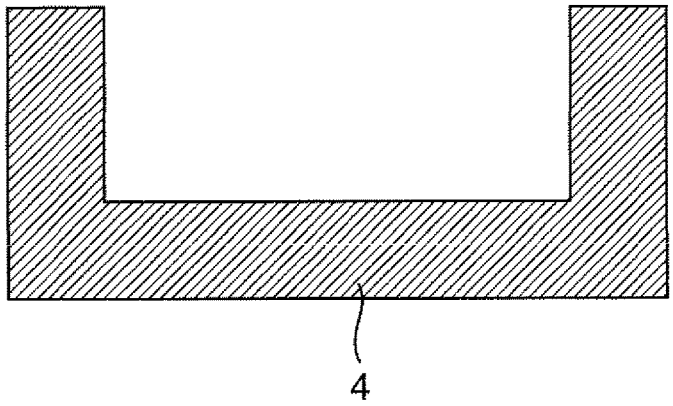
FIG. 2C is a longitudinal sectional view of the on-site soil.
Figure 2D:
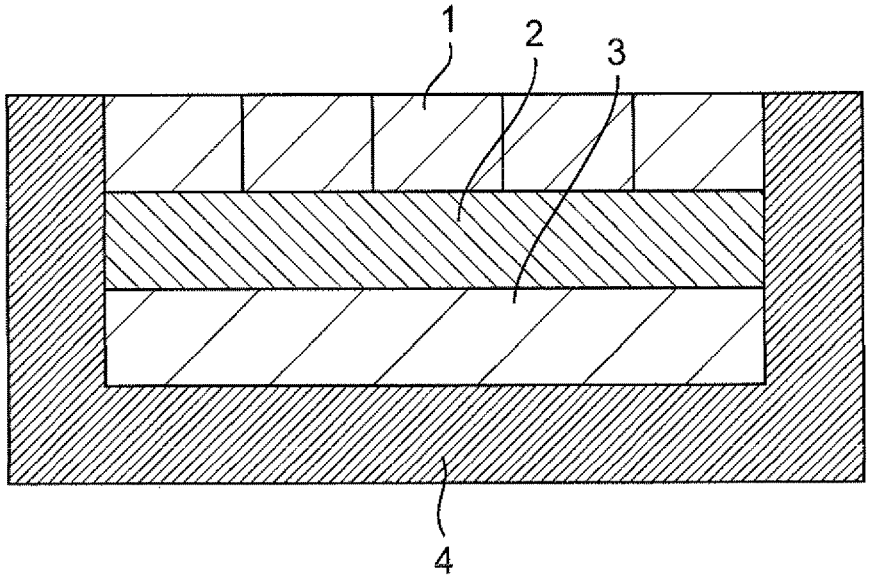
FIG. 2D is a longitudinal sectional view of a water storage structure according to the first embodiment.

From the state of on-site soil 4 shown in FIG. 2B as one example of a portion to be provided with the water storage structure 100, the on-site soil 4 is removed partially as shown in FIG. 2C. As shown in FIG. 2D, the water storage structure 100 is placed in the portion where the on-site soil 4 is removed partially with the periphery of the on-site soil 4 being left.

Figure 2E:
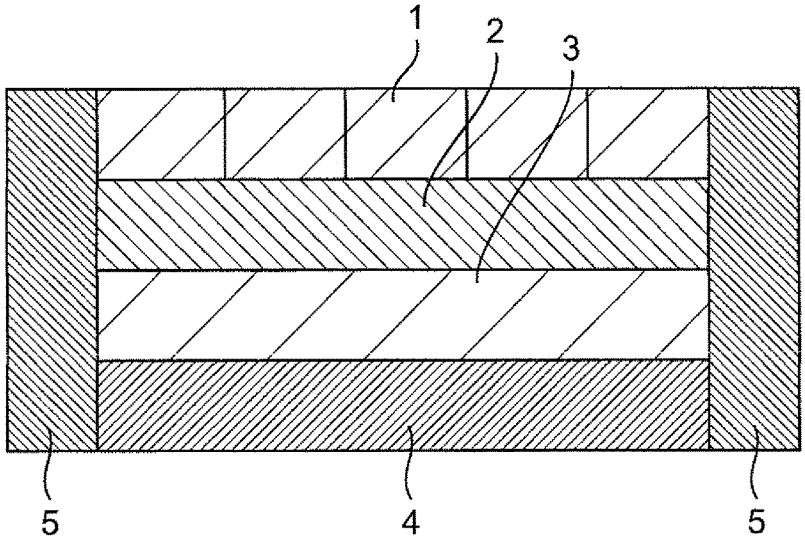
FIG. 2E is a longitudinal sectional view of a water storage structure according to the first embodiment.

The water storage structure 100 is thus located with the periphery being surrounded with the on-site soil 4, for example. Alternatively, as shown in FIG. 2E, the entire side surface of the water storage structure 100 can be provided with a frame 5.

The on-site soil 4 provided under the water storage structure 100 has only to be made of a material allowing liquid to pass therethrough.

The frame 5 can be configured by the on-site soil 4 or can be made of a material other than the on-site soil 4. In other words, the on-site soil 4 or the frame 5 provided at the side surface of the water storage structure 100 can be made of a substance that allows liquid or gas to pass therethrough or a substance that does not allow liquid or gas to pass therethrough. The water storage structure 100 has only to be provided with a substance surrounding the bottom surface and part of the side surface.

<Exemplary Configuration of Water Storage Structure 100>

Described is a specific example of the water storage structure 100. In the example, the water storage structure 100 is provided in a partial region of 5 m×5 m in a sidewalk. The region of 5 m×5 m is also referred to as a construction location. Described below is a method of forming the water storage structure 100.

<Step S001>

As shown in FIG. 2C, a site of 5 m×5 m at the construction location is dug to reach the depth of 20 cm. This depth corresponds to the thickness obtained by summing the thickness of the impermeable layer 3, the thickness of the water retentive layer 2, and the thickness of the pavement layer 1.

<Step S002>

The impermeable layer 3 formed by an aggregation of hydrophobic particles is then formed on the on-site soil 4.

For example, the hydrophobic particles can be water repellent sand that has particle diameters in the range of from 0.425 mm to 0.85 mm and is made of sea sand processed by water repellent treatment. The impermeable layer 3 can have an arbitrary thickness. For example, the impermeable layer 3 has thickness in the range of from 5 cm to 7 cm.

<Step S003>

The water retentive layer 2 is then formed on the impermeable layer 3. For example, the water retentive layer 2 is formed to have 7 cm in thickness.

A commercial water retentive block typically has a volume water content ratio in the range of from 15% to 30% at saturation. For example, the water retentive layer 2 according to the first embodiment includes Toyoura sand that has the volume water content ratio of 38% at saturation.

Toyoura sand is collected at Toyoura beach in Yamaguchi Prefecture. For example, Toyoura sand has particle diameters in the range of from 0.1 mm to 0.4 mm.

<Step S004>

The pavement layer 1 having water absorbency is then formed on the water retentive layer 2. For example, the pavement layer 1 is formed to have 6 cm in thickness.

The pavement layer 1 is provided with the large number of tubes 1*c* that penetrate from the upper pavement surface (first surface) 1*a* to the lower pavement surface (second surface) 1*b* and each have a minute inner diameter. For example, the pavement layer 1 has the function of raising liquid in the tubes 1*c* having the minute inner diameters from the lower pavement surface 1*b* toward the upper pavement surface 1*a*.

The pavement layer 1 absorbs liquid contained in the water retentive layer 2 or liquid contained in the pavement layer 1 so as to reach the upper pavement surface 1*a*. The liquid absorbed to reach the upper pavement surface 1*a* evaporates.

<Method of Producing Impermeable Layer 3>

Figure 3:
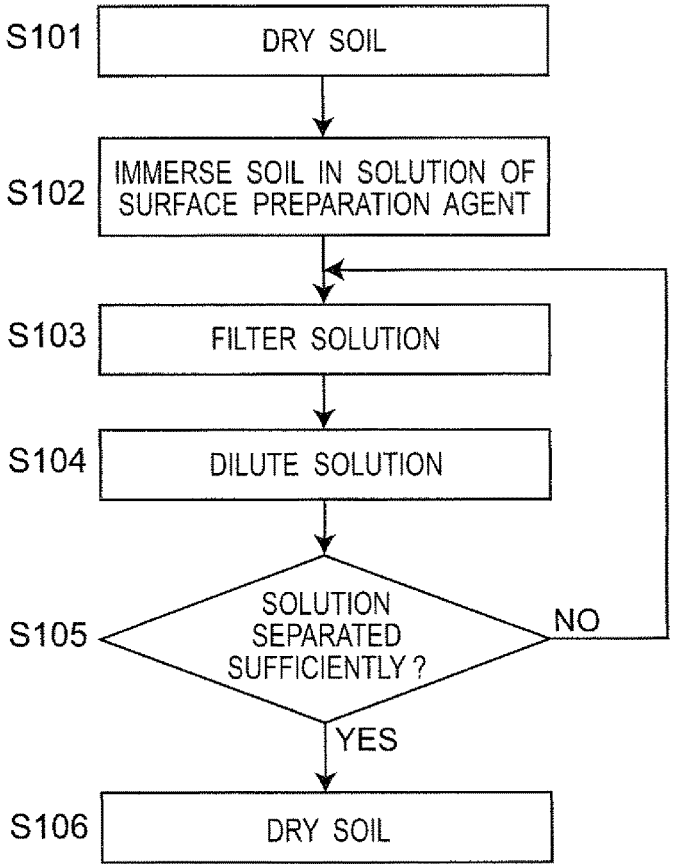
FIG. 3 is a flowchart depicting the procedure of water repellent treatment to sand in the first embodiment.

FIG. 3 shows a method of producing the impermeable layer 3. The impermeable layer 3 is made of sea sand in this example.

<Step S101>

For example, sea sand having particle diameters in the range of from 0.425 mm to 0.85 mm is dried. The sea sand can be dried forcibly in a drying room or a drier, or can be dried naturally with solar heat or the like.

The sea sand is dried and its weight is measured. This process is repeated and the drying is completed when change in weight of the sea sand is reduced to be equal to or less than a predetermined value.

In the case where the sea sand is dried in a drying room or a drier, a container accommodating the sea sand and a gravimeter are inserted into the drying room or the drier. Change in weight of the sea sand is checked in a state where the sea sand is dried in the drying room or the drier that constantly has high internal temperature.

For example, the sea sand in the container is dried while being stirred in the drying room or the drier that is set to about 50° C. The drying is completed when change in weight does not exceed the predetermined value.

In the case of natural drying, sea sand is dried with solar light or the like. Sea sand of an amount occupying the height of several centimeters (e.g. 3 cm) of the container is inserted in the container. The container accommodating the sea sand is placed on the gravimeter and left outside.

Change in weight per unit time is measured. It is regarded that soil of 3 cm thick or the like at and near the surface has been dried when the change in weight does not exceed the predetermined value. After the sea sand thus dried is collected, sea sand thereunder is dried naturally in a similar manner.

<Step S102>

The dried sea sand is then immersed in solution of a surface preparation agent. As one examples of the solution of the surface preparation agent, a fluorine system solvent or a hydrocarbon system solvent may be used. In a case where the sea sand is immersed still without being stirred, the sea sand is left in the solution for about one day and then the solution is filtered, for example.

<Step S103>

After the filtration, the sea sand is then cleaned in detergent for surface preparation agent. In the case where the surface preparation agent is a fluorine system solvent, used as the cleaning solution is a fluorine system solvent such as Fluorinert (registered trademark) or Novec (registered trademark).

In the case where the surface preparation agent is a hydrocarbon system solvent, used as the cleaning solution is a liquid mixture of hexane or hexadecane and chloroform.

<Step S104>

Next, the cleaned sea sand is partially extracted to check whether or not the water repellent treatment to the sea sand is completed. For example, if the sea sand is visually recognized as repelling the detergent, it is determined that the water repellent treatment is completed. If it is observed that the surface of the sea sand is wet with the detergent, it is determined that the water repellent treatment to the sea sand is not completed. In this case, the processes in steps S102 and S103 are repeated.

<Step S105>

Then, after confirming that the surface of the sea sand repels the detergent, the sea sand is dried.

The sea sand is exemplified in the above method of producing the impermeable layer 3. Treatment similar to the above is also applicable to a case where water repellent treatment is applied to the on-site soil 4 or where glass beads are used as the material.

Figure 4:
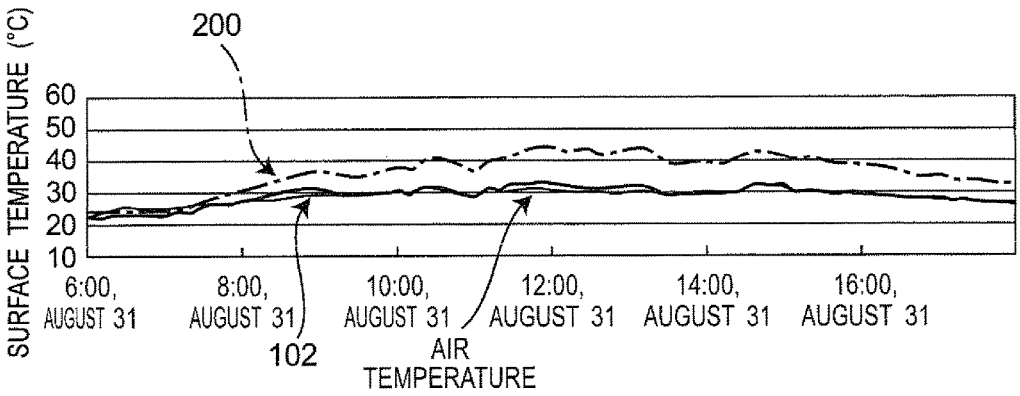
FIG. 4 is a graph indicating cooling effects of the water storage structure according to the first embodiment and a water storage structure according to a comparative example.

FIG. 4 indicates results of a verification test on a water storage structure (water storage system) 102 according to a first working example of the first embodiment and a water storage structure (water storage system) 200 according to a comparative example. The bold line in FIG. 4 indicates results on the water storage structure 102 and the dashed line indicates results of the water storage structure 200, while the thin line indicates air temperature.

<First Working Example>

Figure 5A:
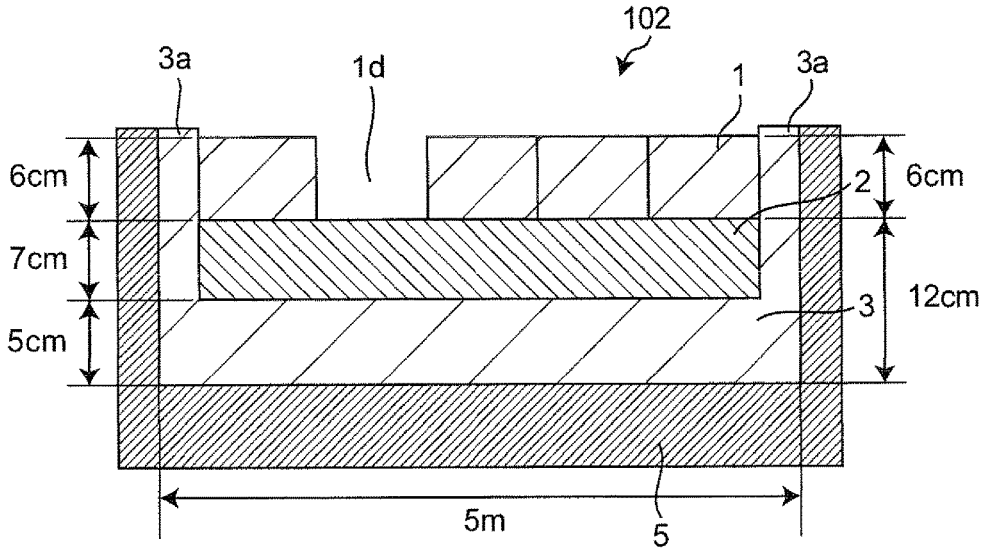
FIG. 5A is a longitudinal sectional view of a water storage structure according to a first working example.
Figure 5B:
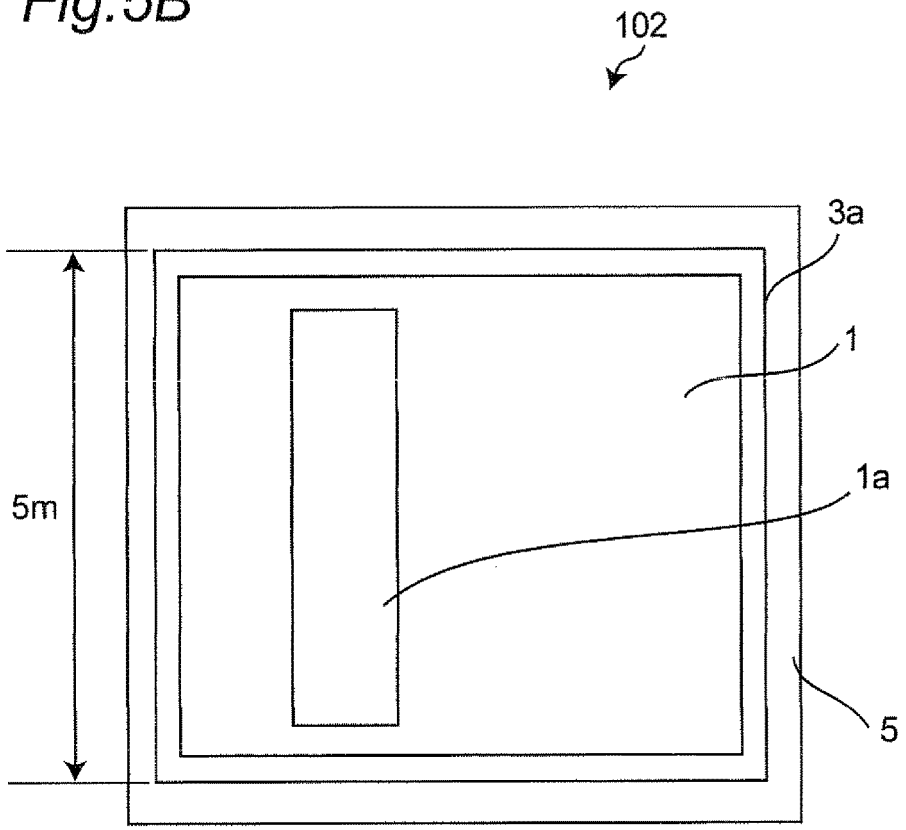
FIG. 5B is a top view of the water storage structure according to the first working example.

FIG. 5A is a sectional view of the water storage structure 102 according to the first working example. FIG. 5B is a top view of the water storage structure 102 according to the first working example.

The water storage structure 102 includes a water retentive layer 2 that is made of Toyoura sand not processed by water repellent treatment. The impermeable layer 3 of the water storage structure 102 is made of sea sand of which surface is processed by water repellent treatment. The water storage structure 102 is surrounded with a wooden frame 5.

In order to check the cooling effects on the surface temperature of the water storage structure 102, checked was temporal change in surface temperature in a case where water was supplied to the water storage structure 102. The results thus obtained were compared with temporal change in surface temperature of a water retentive block 9 that has been conventionally developed for alleviation of the heat island effect according to the comparative example.

Figure 5C:
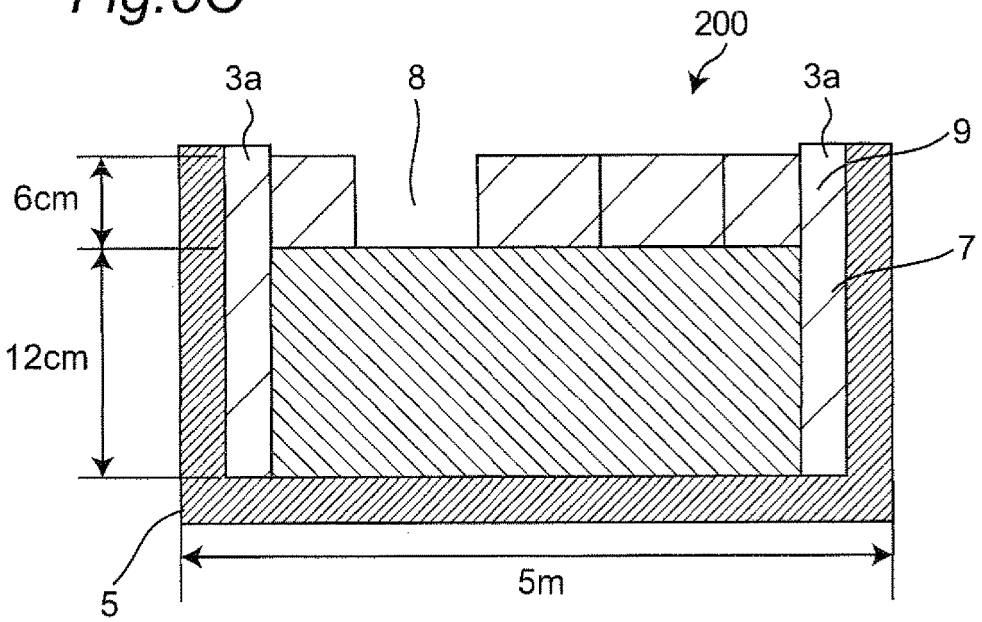
FIG. 5C is a longitudinal sectional view of a water storage structure according to a first comparative example.
Figure 5D:
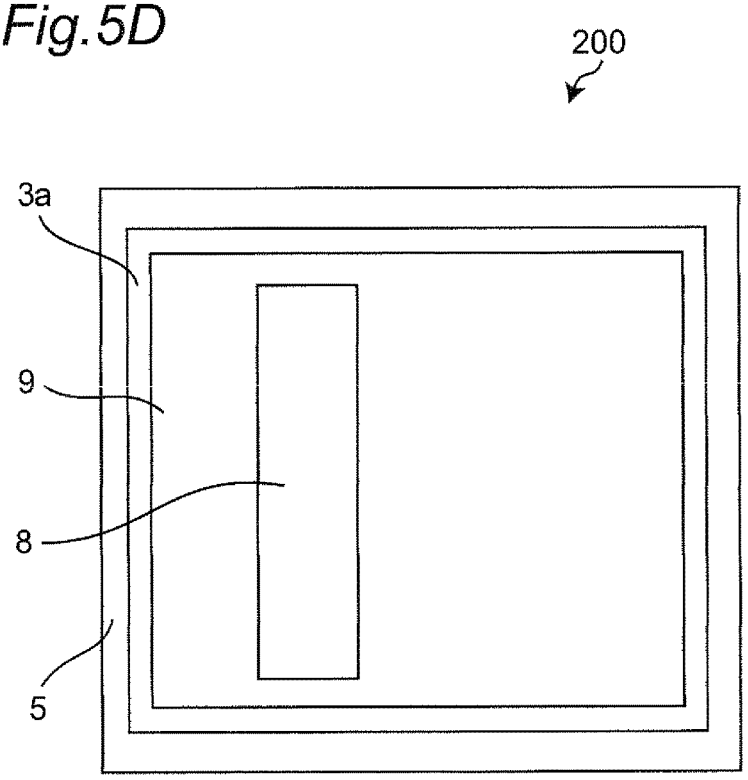
FIG. 5D is a top view of the water storage structure according to the first comparative example.

FIG. 5C is a sectional view of the water storage structure 200 according to a first comparative example. FIG. 5D is a top view of the water storage structure 200 according to the first comparative example.

Each of the water storage structures 102 and 200 was placed in the wooden frame 5 having internal dimensions of 5 m×5 m. In short, each of the water storage structures 102 and 200 is set in the wooden frame 5 in the first working example. The wooden frame 5 is provided to suppress liquid supplied to the surface of the pavement layer 1 or the water retentive block 9 from flowing along the side surface of the water storage structure 102 or 200. The function of each of the water storage structures 102 and 200 is not largely influenced in the configuration in which the wooden frame 5 surrounds the water storage structure 102 or 200. It is obvious that similar results will be achieved as long as each of the water storage structures 102 and 200 is surrounded with any component in place of the wooden frame 5.

The water storage structure 102 is provided, in the wooden frame 5 of 18 cm in height, with water repellent sand configuring the impermeable layer 3 of 6 cm in height. Toyoura sand configuring the water retentive layer 2 of 6 cm in height is placed thereon. Placed further thereon are red bricks configuring the pavement layer 1 of 6 cm in depth.

In each of the water storage structures 102 and 200, water repellent sand was filled in gaps between the Toyoura sand or the bricks and the wooden frame 5 to form an outer frame impermeable layer 3*a* that inhibits leakage of liquid through the wooden frame 5, so that stored water does not leak out through the wooden frame 5. In order to form the outer frame impermeable layer 3*a* by filling the gaps with the water repellent sand, the water repellent sand can be filled in bags that are to be filled in the gaps. Thus, the water repellent sand filled in the bags does not leak out of gaps between adjacent blocks, thereby facilitating the construction. It is noted that the difference between the water storage structures 102 and 200 is recognized similarly regardless of whether or not the water repellent sand is filled in the gaps.

The water storage structure 200 according to the comparative example includes Toyoura sand 7 that is 12 cm high and that is placed in the similar wooden frame 5. The water retentive blocks 9 of 6 cm in height are set thereon. The water retentive blocks 9 each have the optimum water content ratio of 18% and are prepared for the heat island effect.

The total depth of the Toyoura sand 7 and the water retentive blocks 9 in the water storage structure 200 is equal to the total depth of the pavement layer 1, the water retentive layer 2, and the impermeable layer 3 in the water storage structure 102.

As shown in FIGS. 5A and 5C, red bricks 1 and the water retentive blocks 9 are not placed entirely. Instead, as exemplified in FIGS. 5B and 5D, there was formed a space of 50 cm×470 cm surrounded with the red bricks 1 or the water retentive blocks 9 so as to form a water tank 1*a* or 8.

Details of the test are described below. Each of the water storage structures 102 and 200 is supplied on the surface with an equal amount of water. Temperature of the surface of each of the pavement layer 1 and the water retentive blocks 9 is measured per unit time. Temporal changes in respective surface temperatures of the pavement layer 1 and the water retentive blocks 9 are then compared with each other.

In the test, water was supplied assuming that an evening shower of 60 mm fallen in one hour from 18 o'clock on one day before the test was carried out, for example.

In the water storage structure 200 shown in FIGS. 5C and 5D, upon supply of water of about 50 mm, the water overflew from the surface of the water retentive block 9.

In contrast, in the water storage structure 102 shown in FIGS. 5A and 5B, water was stored in gaps between the red bricks included in the pavement layer 1 and did not leak from the surface thereof.

In these states, the surface temperature was measured continuously from 6 o'clock to 18 o'clock on the next day. As to the weather, it was a fine weather summer day having air temperature exceeding 30 degrees in the daytime, as indicated by the thin line in FIG. 4.

The surfaces of the water retentive blocks 9 in the water storage structure 200 got dried at the midmorning and the surface temperature was raised, whereas it was verified that the water storage structure 102 including the impermeable layer 3 made of the water repellent sand had the surface temperature kept at the level in the morning throughout the day and the surface was kept wet on the entire day.

The water infiltration pressure of the impermeable layer 3 made of the water repellent sand is also measured in order to estimate a flow of water in the water storage structure 102 in a case where a large amount of water is supplied.

Figure 6:
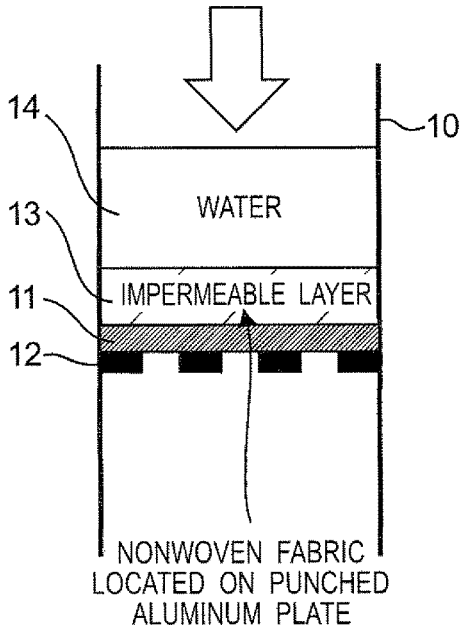
FIG. 6 is a view showing conditions of a test for finding the relationship between the particle diameter of water repellent sand and the water infiltration pressure in the first embodiment.
Figure 8C:
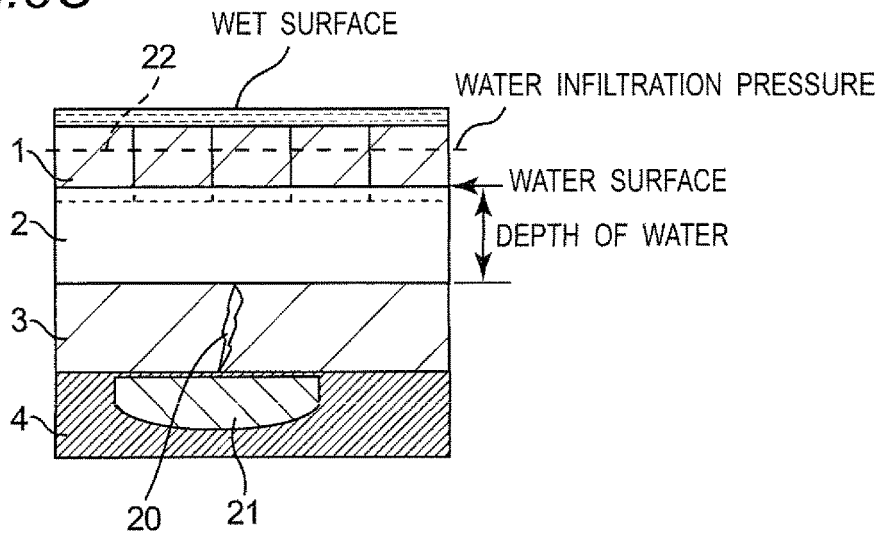
FIG. 8C is a longitudinal sectional view showing a flow of water in the water storage structure according to the first embodiment.
Figure 8D:
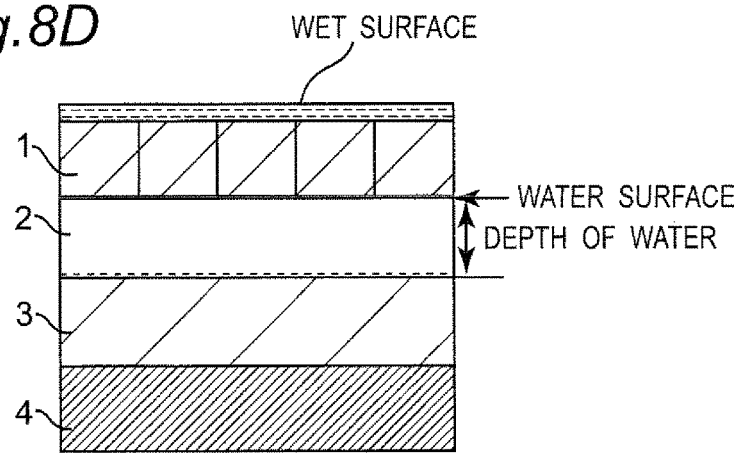
FIG. 8D is a longitudinal sectional view showing a flow of water in the water storage structure according to the first embodiment.
Figure 8E:
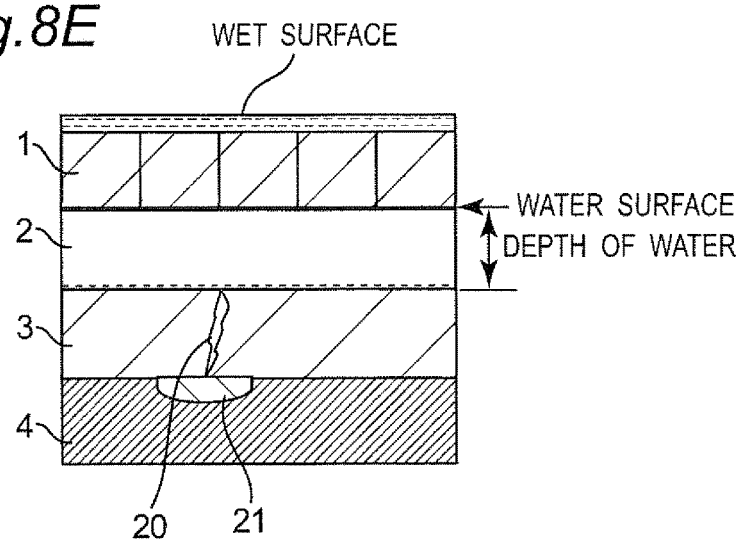
FIG. 8E is a longitudinal sectional view showing a flow of water in the water storage structure according to the first embodiment.

FIG. 6 shows the configuration adopted in a water permeation test.

An aluminum plate 12 provided with a plurality of holes of 5 mm in diameter is fixed to a cylinder 10. The cylinder 10 is made of glass. The aluminum plate 12 is provided thereon with nonwoven fabric 11 having texture of 0.01 mm. The nonwoven fabric 11 is provided thereon with an impermeable layer 13. Water is supplied onto the impermeable layer 13.

FIG. 7 indicates conditions applied in the test. The water permeation test was carried out using, as the impermeable layer 13, each of (1) water repellent glass balls each having a particle diameter of 0.03 mm, (2) water repellent Toyoura sand having particle diameters from 0.1 mm to 0.4 mm, (3) water repellent sea sand having particle diameters from 0.425 mm to 0.85 mm, and (4) Toyoura sand having particle diameters from 0.1 mm to 0.4 mm and having no water repellency.

The particle diameters were measured through the sieve analysis. In the sieve analysis, a sample is caused to path through sieves having meshes of different sizes in the order of the size of the meshes from the loosest sieve or from the finest sieve so as to measure the weight of the sample remaining on each of the sieves.

Exemplified herein is a method of extracting water repellent Toyoura sand having particle diameters from 0.1 mm to 0.4 mm. The water repellent Toyoura sand was caused to pass through a sieve having meshes of 0.4 mm, so as to separate water repellent Toyoura sand having particle diameters larger than 0.4 mm. Subsequently, the remaining water repellent Toyoura sand having particle diameters equal to or less than 0.4 mm was caused to pass through a sieve having meshes of 0.1 mm, so as to separate water repellent Toyoura sand having particle diameters smaller than 0.1 mm. Finally extracted was the water repellent Toyoura sand having particle diameters from 0.1 mm to 0.4 mm.

The test method is described next.

The nonwoven fabric 11 is provided thereon with the impermeable layer 13 made of any one of the materials from (1) to (4) mentioned above. A constant amount of water 14 is supplied onto the impermeable layer 3 per unit time. In particular, 10 mm of water was supplied in every five minutes.

The water infiltration pressure was then measured when the impermeable layer 13 was broken and the water started to pass through and reach under the impermeable layer 13. This test was carried out similarly using the impermeable layer 13 made of each of the other materials.

The results of the test are described below. The water repellent glass having average particle diameters of 0.03 mm corresponding to the material (1) had the water infiltration pressure of 100 cm. The water repellent Toyoura sand having average particle diameters of 0.15 mm corresponding to the material (2) had the water infiltration pressure of 21 cm. The water repellent sand (sea sand) having average particle diameters of 0.8 mm corresponding to the material (3) had the water infiltration pressure of 10 cm. The Toyoura sand having no water repellency and having average particle diameters of 0.15 mm corresponding to the material (4) had the water infiltration pressure of 2 cm.

The water repellent sea sand included in the impermeable layer 3 according to the first working example had the water infiltration pressure of 10 cm. In a case where the total thickness of the water retentive layer 2 and the pavement layer 1 is equal to or more than 10 cm, the impermeable layer 3 made of the water repellent sea sand is broken before the water stored on the water repellent sea sand reaches the surface of the pavement layer 1.

Whether the surface of water contained in the pavement layer 1 and the water retentive layer 2 rises or falls is dependent on the relationship between the speed of supplied water and the speed of water drained from a broken portion. If the impermeable layer 3 cannot withstand water pressure equal to or more than the water infiltration pressure, the impermeable layer 3 is further broken. In this case, the water surface is kept with no rise, and the water surface falls when supply of water stops.

Accordingly, as mentioned earlier, in such a case where the structure including the respective layers is constructed such that the water retentive layer 2 according to the first working example is formed to be 7 cm thick and the pavement layer 1 is formed thereon with blocks of 6 cm thick, which are used normally and often, assume that the water repellent sand in the impermeable layer 3 is broken at 10 cm. There is caused breakage before the water surface reaches the surface of the pavement layer 1 while water less possibly overflows from the surface of the pavement layer 1. The water surface starts to fall when the amount of supplied water decreases or supply of water stops.

<Water Storage Structure 100>

Described with reference to FIGS. 5A to 8F is the operation of storing liquid in the water storage structure 100 according to the typical example of the first embodiment. This operation is similarly performed in each of the water storage structures 101 and 102.

Exemplified is a case where rainwater due to torrential rain or guerrilla heavy rain is supplied to the water storage structure 100. In this example, rainwater of an amount exceeding the capacity of the water storage structure 100 is supplied and the rainwater thus passes through (breaks) the impermeable layer 3. FIGS. 8A to 8F show the states changed in chronological order.

<FIG. 8A>

Water supplied onto the surface of the pavement layer 1 passes through the pavement layer 1 and is held in the water retentive layer 2.

If water of an amount exceeding the capacity of the water retentive layer 2 is supplied to the water storage structure 100, the water does not pass through the impermeable layer 3 that has hydrophobicity but is stored in the pavement layer 1. The length from the surfaces at which the water retentive layer 2 and the impermeable layer 3 are in contact with each other to the water surface is referred to as "depth of water" in this case.

The pavement layer 1 absorbs the water in the water retentive layer 2 so as to reach the surface of the pavement layer 1. The surface of the pavement layer 1 thus gets wet. Atmosphere temperature of the wet surface can be decreased when water contained in the wet surface evaporates.

<FIG. 8B>

If pressure corresponding to the amount of water stored in the pavement layer 1 and the water retentive layer 2 exceeds the degree of the water infiltration pressure of the impermeable layer 3, the impermeable layer 3 is broken (see reference sign 20 in FIG. 8B). After the impermeable layer 3 is broken, the water stored in the pavement layer 1 and the water retentive layer 2 passes through the impermeable layer 3 and flows into the on-site soil 4 (see the portion of the on-site soil 4 containing water as denoted by reference sign 21 in FIG. 8B). The passage of water through the impermeable layer 3 is referred to as "drainage". The portion through which water flows due to the breakage of the impermeable layer 3 is referred to as the "broken portion" (see the portion denoted by reference sign 20 in FIG. 8B).

The degree of water infiltration pressure of the impermeable layer 3 corresponds to the water infiltration pressure. The depth of water corresponding to the degree of the water infiltration pressure of the impermeable layer 3 is indicated by a dotted line 22 in each of FIGS. 8A to 8D.

When water flows into the on-site soil 4, the storing speed of water stored in the pavement layer 1 and the water retentive layer 2 is decreased dependently on the relationship with the water supplied to the pavement layer 1. Otherwise, the water surface starts to fall along with decrease in depth of water.

<FIG. 8C>

If water is continuously drained through the impermeable layer 3, downward drainage through a broken portion 20 does not stop even if the depth of water decreases and then, the pressure is reduced to be equal to or less than the water infiltration pressure. The water surface further falls and water is drained until the water retentive layer 2 has a holdable water amount ratio. Hereinafter, the holdable water amount ratio is also referred to as the "optimum water content ratio". The holdable water amount ratio means the ratio between the volume of the gaps in the water retentive layer 2 and the volume of holdable water. As described earlier in connection with the ratio between the material for the water retentive layer 2 and water, the ratio between the material for the impermeable layer 3 and the amount of holdable water is also referred to as the optimum water content ratio.

<FIG. 8D>

Drainage through the impermeable layer 3 stops if the amount of water contained in the water retentive layer 2 has a ratio substantially equal to the optimum water content ratio. For example, the water repellent Toyoura sand in the impermeable layer 3 has the optimum water content ratio of about 16%. The pavement layer 1 continuously absorbs the water contained in the water retentive layer 2 so as to reach the surface of the pavement layer 1 until the amount of water reaches the optimum water content ratio or in the state where the amount of water has the optimum water content ratio, so that the surface of the pavement layer 1 can be kept wet.

<FIG. 8E>

Even if water flowing through the impermeable layer 3 once stops, the impermeable layer 3 is likely to be broken again. The broken portion 20 in the impermeable layer 3 corresponds to a path through which water has passed. Hereinafter, the path through which water has passed is also referred to as a "water path".

As long as water remains in the water path, the water path tends to allow water supplied to the impermeable layer 3 to pass therethrough again. In other words, breakage is possibly caused again even in a case where the amount of water contained in the pavement layer 1 and the water retentive layer 2 is less than the amount of water applying pressure equal to or less than the water infiltration pressure. Even if water is supplied to the pavement layer 1, the supplied water is not stored in the pavement layer 1 initially supplied thereto or in the water retentive layer 2 but is possibly drained through the broken portion 20.

The water storage structure 100, which includes the water retentive layer 2 capable of holding a constant amount of water, can thus have a period of time until the water path gets dried. In this manner, the broken portion 20 in the impermeable layer 3 can be dried.

<FIG. 8F>

When the broken portion 20 is dried and contains no water, the impermeable layer 3 is capable of storing water even though the pavement layer 1 and the water retentive layer 2 contain the amount of water applying pressure lower than the water infiltration pressure. In short, the water storage structure 100 is capable of storing water equal to or more than the amount of water contained in the water retentive layer 2.

In order to adjust the water infiltration pressure, the particles can include hydrophobic particles, and hydrophobic particles and particles with no hydrophobicity which are mixed together. The water infiltration pressure can be adjusted by changing the mixture ratio.

FIG. 9 indicates results of the test on the relationship between the mixture percentage (mixture ratio) of sea sand not processed by water repellent treatment to sea sand processed by water repellent treatment and the water infiltration pressure (critical water level). Sand including sea sand not processed by water repellent treatment and sea sand processed by water repellent treatment is also referred to as a "sand mixture".

For example, sand including sand not processed by water repellent treatment and sand processed by water repellent treatment mixed at the ratio of 1:7 has the water infiltration pressure corresponding to the height of 8 cm. When the impermeable layer 3 is made of the sand mixture, it is possible to achieve the effects same as those described above by reducing the thickness of the water retentive layer 2 by 2 cm.

When liquid of a constant amount or less is supplied, the water storage structure 100 according to the first embodiment holds the liquid in the water retentive layer 2 and the pavement layer 1. The surface of the pavement layer 1 can be thus kept wet. When liquid of the constant amount or more is supplied, no more liquid is not stored because the impermeable layer 3 is broken. Accordingly, even if an excessive amount of liquid is supplied, it is thus possible to prevent the problems that the liquid overflows from the surface of the pavement layer 1 to a different portion and the water storage structure 100 deteriorates in strength.

Furthermore, even if the impermeable layer 3 is broken and the liquid in the pavement layer 1 is drained, the water retentive layer 2 holds liquid. The pavement layer 1 can be kept wet until water in the water retentive layer 2 evaporates.

Moreover, when the impermeable layer 3 is broken, water corresponding to the amount or more than that can be held in the water retentive layer 2 is drained. If water in the water path once stops after the drainage and the water path gets dried, the gaps are filled with air again and impermeability is recovered. It is thus possible to store water again in the water retentive layer 2 and the pavement layer 1 serving as the water tanks with no particular repair.

The water storage structure 100 is configured by simply layering the materials, thereby to be advantageously capable of draining excessive water with no use of special bags or with no trouble of complicated construction as in the conventional art.

According to a first exemplary aspect of the first embodiment, the impermeable layer 3 of the water repellent sand layer formed by the aggregation of the sand processed by water repellent treatment as examples of hydrophobic particles is placed underground to store water. The water storage structure 100 is thus possible to suppress rise in temperature of the upper pavement surface 1*a* with use of the stored water as well as suppress water from overflowing on the surface of the water storage structure 100, in other words, the ground surface even when excessive water is supplied, with no deterioration in strength of the water storage structure 100.

According to a second exemplary aspect of the first embodiment, the impermeable layer 3 is formed so as to include the aggregation of the hydrophobic particles and air in gaps between the adjacent particles. Furthermore, placed on the impermeable layer 3 located underground is water retentive soil or water retentive blocks as one example of the water retentive layer 2 that is capable of holding a constant amount of water. Placed further thereon are water absorbing blocks as one example of the pavement layer 1. In this configuration, it is possible to suppress water from overflowing on the surface of the water storage structure 100 while water of a constant amount or less is held underground and the strength of the water storage structure 100 is kept after the held water reaches or exceeds the constant amount.

According to the third exemplary aspect of the first embodiment, in the first exemplary aspect, the total thickness of the water retentive soil or the water retentive blocks in the water retentive layer 2 provided on the impermeable layer 3 and the water absorbing blocks in the pavement layer 1 is set to correspond to be larger than the water infiltration pressure of the impermeable layer 3. In this configuration, while water of an amount corresponding to be smaller than the water infiltration pressure is held underground, the impermeable layer 3 causes water to pass therethrough if the amount of held water corresponds to be equal to or more than the water infiltration pressure. It is thus possible to suppress water from overflowing on the surface of the water storage structure 100.

According to a fourth exemplary aspect of the first embodiment, in the second exemplary aspect, the adjacent water absorbing blocks form the gap (through hole) 1*d* that is designed to serve as a water storage space. This configuration achieves the effects similar to those of the second exemplary aspect and also efficiently suppresses rise in surface temperature of the water storage structure 100 with use of the supplied water.

In the water storage structure 100 according to the first embodiment, water evaporates at the surface of the water storage structure 100, in other words, the ground surface, even in a case where a small amount of water is supplied to wet the surface, thereby efficiently cooling the surface. Even in another case where a large amount of water is supplied, the impermeable layer 3 formed by the aggregation of the hydrophobic particles does not cause the water to overflow on the surface but is capable of appropriately draining the water. It is possible to constantly keep the ground surface appropriately wet regardless of the amount of the supplied water, thereby to efficiently cool the ground surface.

In contrast, assume a water storage structure according to the comparative example including only the impermeable layer and the pavement layer but not including a water retentive layer. In this structure, water can be stored by providing the impermeable layer entirely underground. The stored water is absorbed so as to be close to the surface through the capillary tubes in the pavement layer to keep the ground surface wet, so that evaporation and cooling can be efficiently performed at the ground surface.

Such a structure, however, disadvantageously drains entire water when excessive water is supplied.

In contrast, the impermeable layer 3 according to the first embodiment is made of the aggregation of hydrophobic particles, so that the impermeable layer 3 is broken upon application of water pressure of a constant degree or more. Appropriately designing the height of each of the pavement layer 1, the water retentive layer 2, and the impermeable layer 3 enables drainage of water through breakage before the water overflows.

Furthermore, according to the comparative example, once the impermeable layer 3 made of the hydrophobic particles is broken to form a water path, the water shield effect is not exerted until the gap serving as the water path gets dried. There is a problem that, when supply of water stops, the ground surface is dried soon and the surface temperature cannot be decreased.

In order to solve this problem, the water storage structure 100 according to the first embodiment includes the water retentive layer 2 that is provided between the pavement layer 1 and the impermeable layer 3. In this configuration, the water in the water retentive layer 2 can be supplied to the pavement layer 1 until the water path in the impermeable layer 3 gets dried. It is thus possible to shorten a period of time in which the surface temperature is not decreased.

<Modification Example>

The impermeable layer 3 according to the first embodiment is made of a single material (the sea sand in the first working example). In the modification example, the impermeable layer 3 can be partially made of hydrophobic particles that have water infiltration pressure lower than the water infiltration pressure of the other portion.

FIG. 10 shows a water storage structure 103 including an impermeable layer 3 that is partially made of water repellent sand having particle diameters larger than those of the sea sand. The portion included in the impermeable layer 3 and made of the water repellent sand having the particle diameters larger than those of the sea sand is referred to as a drain hole portion 6.

When an excessive amount of water is supplied to the water storage structure 103, the drain hole portion 6 is broken and the liquid flows through the broken portion. It is thus possible to intentionally specify the location through which water is drained. If the amount of stored water needs to be adjusted after the construction of the water storage structure 103, it is possible to easily conduct adjustment work by digging only the portion to serve as the drain hole portion 6 and modifying the conditions of the drain hole (such as the particle diameters or the mixture ratio with sand with no water repellency).

(Second Embodiment)

Figure 11:
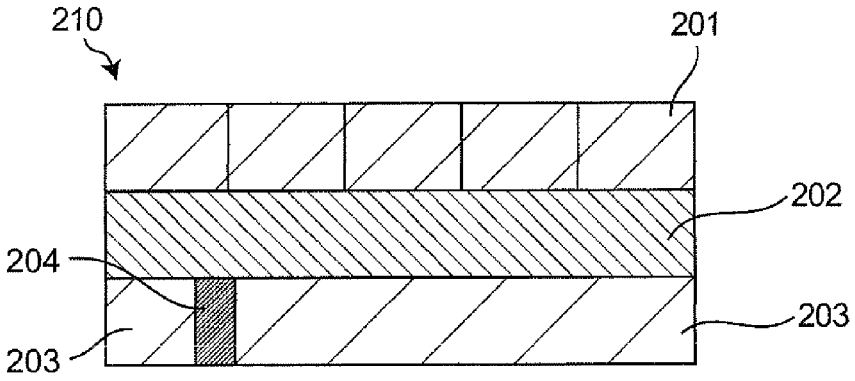
FIG. 11 is a longitudinal sectional view of a water storage structure according to a second embodiment.

FIG. 11 shows a configuration of a water storage structure (water storage system) 210 according to the second embodiment different from the first embodiment. The water storage structure 210 includes a pavement layer 201, a water retentive layer 202, an impermeable layer 203, and a drain hole portion 204 provided partially in the impermeable layer 203.

The water storage structure 210 thus configured is described below. The pavement layer 201 or the water retentive layer 202 is similar to the corresponding portion according to the first embodiment.

The impermeable layer 203 can be made of hydrophobic particles described in the first embodiment, or can be made of any other material that does not allow water to pass therethrough.

The material not allowing passage of water can include fine particles such as silt or clay, can include solid matter configured by a hydrophobic material, or can include a hydrophilic material having a surface coated with a hydrophobic material.

The drain hole portion 204 is located partially in the impermeable layer 203 so as to penetrate the impermeable layer 203. The drain hole portion 204 is formed by hydrophobic particles having water infiltration pressure lower than the water infiltration pressure of the impermeable layer 203. The water infiltration pressure of the layer of the hydrophobic particles in the drain hole portion 204 is varied in accordance with the diameters of the hydrophobic particles, distribution of the particle diameters, or the like. In a case where the impermeable layer 203 is made of water repellent sand obtained by applying water repellent treatment to Toyoura sand having particle diameters from 0.1 mm to 0.4 mm, the drain hole portion 204 can be made of sand larger in diameter than the Toyoura sand, such as water repellent sand obtained by applying water repellent treatment to sea sand having particle diameters from 0.425 mm to 0.85 mm.

If pressure of liquid applied to the impermeable layer 203 is equal to or less than the water infiltration pressure of the drain hole portion 204, the liquid does not pass through the drain hole portion 204. Actually, the pressure of water applied to the impermeable layer 203 has a maximum value corresponding to the height of the liquid. In a case where liquid is supplied from a first surface 201*a* of the pavement layer 201, the liquid enters portions where there has been gas contained in the pavement layer 1 and the water retentive layer 2. It is regarded that the entered liquid applies pressure to the impermeable layer 203 and the drain hole portion 204. In this case, the pressure is applied not in accordance with the amount of the gas but simply in accordance with the height of the water.

If the amount of water supplied from the first surface 1*a* of the pavement layer 201 exceeds a constant value and the pressure applied to the impermeable layer 203 and the drain hole portion 204 exceeds the water infiltration pressure of the drain hole portion 204, water infiltrates the drain hole portion 204 and the water stored in the pavement layer 201 or the water retentive layer 202 is drained downward through the drain hole portion 204. The drain hole portion 204 exerts no water shield effect on water pressure up to the conventional water infiltration pressure as long as water remains in the drain hole portion 204. In this case, the water retentive layer 202 fails to store water. If the drain hole portion 204 is dried, the drain hole portion 204 is again capable of keeping the conventional water infiltration pressure.

For example, soil is removed partially and the water storage structure 210 according to the second embodiment is placed at the removed portion.

Figure 12:
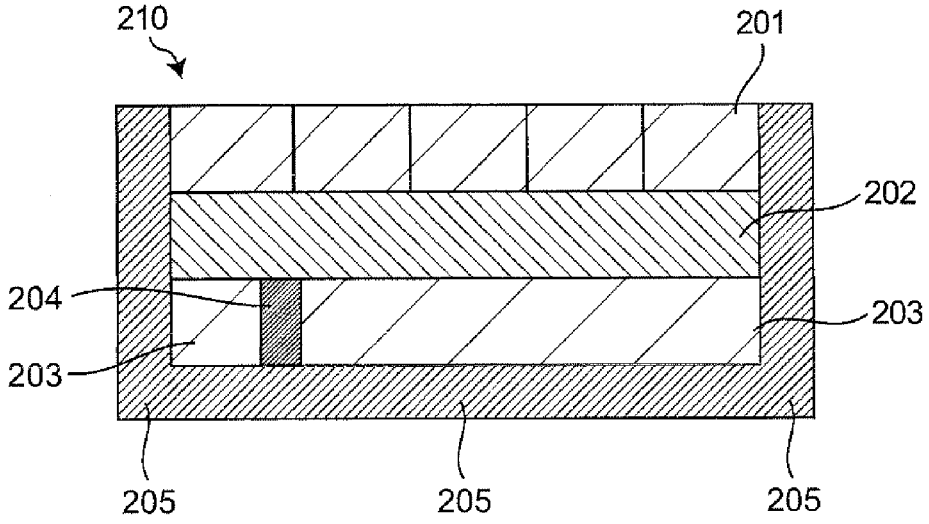
FIG. 12 is a longitudinal sectional view showing a state where the water storage structure according to the second embodiment is located in a portion where on-site soil is partially removed.

For example, as shown in FIG. 12, the water storage structure 210 is placed at a portion where the on-site soil 205 is removed partially. Described is a specific example of the water storage structure 210. In a case where the water storage structure 210 corresponds to a partial region of 5 m×5 m in a side walk, a site of 5 m×5 m at the construction location is dug by 20 cm. This depth corresponds to the thickness obtained by summing the thickness of the impermeable layer 203, the thickness of the water retentive layer 202, and the thickness of the pavement layer 201. This is also similar to the first embodiment.

The impermeable layer 203 and the drain hole portion 204 each formed by an aggregation of hydrophobic particles are formed on the on-site soil 205. For example, the hydrophobic particles in the impermeable layer 203 can be water repellent sand obtained by applying water repellent treatment to Toyoura sand having particle diameters from 0.1 mm to 0.4 mm. The hydrophobic particles in the drain hole portion 204 can be water repellent sand obtained by applying water repellent treatment to sea sand having particle diameters in the range of from 0.425 mm to 0.85 mm. Each of the impermeable layer 203 and the drain hole portion 204 can have an arbitrary thickness. In the present embodiment, the thickness is set within the range of from 5 cm to 7 cm. The impermeable layer 203 and the drain hole portion 204 are equal in thickness. The drain hole portion 204 is provided partially in the impermeable layer 203 such that the drain hole portion 204 is surrounded with the impermeable layer 203.

Figure 13A:
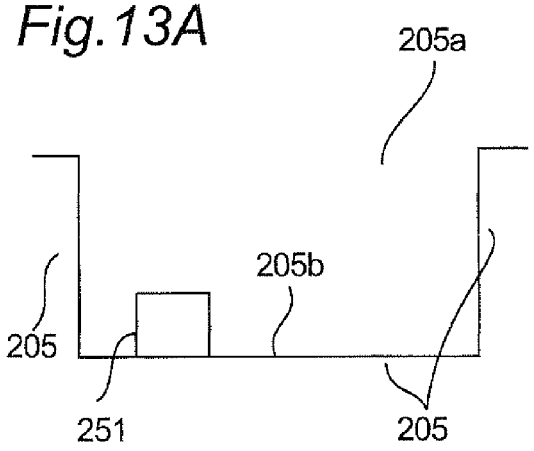
FIG. 13A is a longitudinal sectional view illustrating the building structure of the water storage structure according to the second embodiment.
Figure 13B:
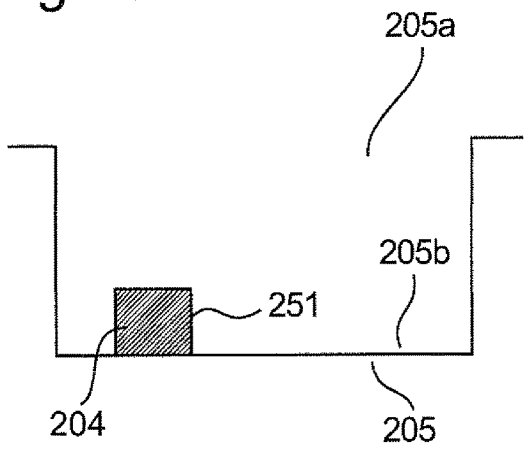
FIG. 13B is a longitudinal sectional view illustrating the building structure of the water storage structure according to the second embodiment.

Described below are the building structures of the impermeable layer 203 and the drain hole portion 204. Initially, a cylindrical mold 251 having a through hole for formation of the drain hole portion 204 is placed on a bottom surface (the surface of the on-site soil 205) 205*b* of a recess 205*a* formed by digging the on-site soil 205 (see FIG. 13A). For example, in a case of providing the drain hole portion 204 having 20 cm in diameter, the mold 251 for the drain hole portion is a cylinder having 20 cm in diameter and 5 cm in height. It is more preferred if the cylindrical mold is thinner, because a gap provided after the mold is removed can be thinner. For example, the mold can be 1 mm thick so as to configure a cylinder by being bent. The mold 251 for the drain hole portion can be made of any material such as plastic. The mold 251 for the drain hole portion is placed at the position to be provided with the drain hole portion 204 on the bottom surface 205*b* of the recess 205*a* formed by digging. Each of the molds 251 for the drain hole portions is filled with the water repellent sand made of sea sand (see FIG. 13B). The water repellent sand configures the drain hole portion 204.

Figure 13C:
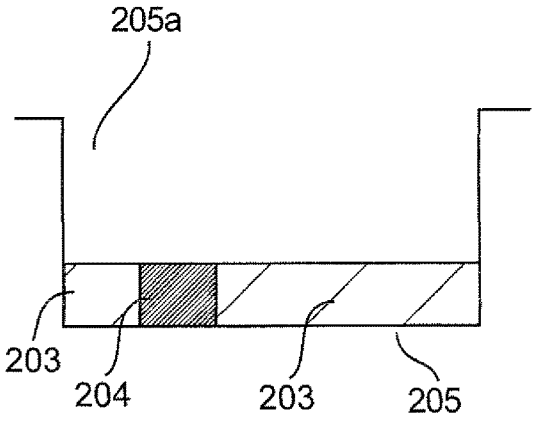
FIG. 13C is a longitudinal sectional view illustrating the building structure of the water storage structure according to the second embodiment.

Next, the water repellent sand made of Toyoura sand is placed to reach the height of the mold 251 for the drain hole portion at positions other than the position of the mold 251 for the drain hole portion on the bottom surface 205*b* of the recess 205*a* formed by digging. The impermeable layer 203 is formed accordingly (see FIG. 13C).

Figure 13D:
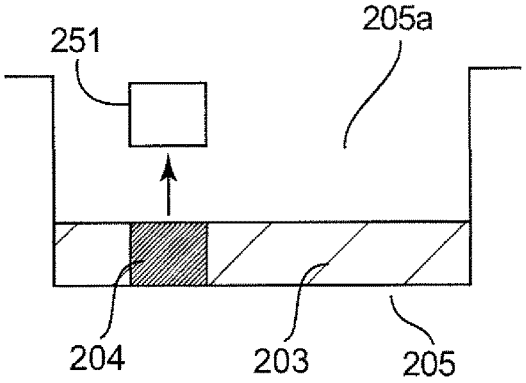
FIG. 13D is a longitudinal sectional view illustrating the building structure of the water storage structure according to the second embodiment.
Figure 13E:
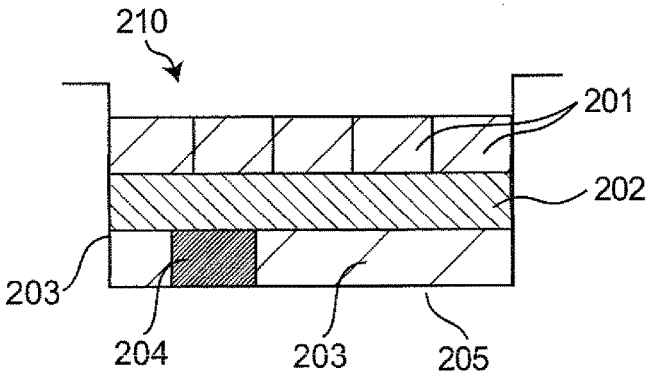
FIG. 13E is a longitudinal sectional view illustrating the building structure of the water storage structure according to the second embodiment.

After the impermeable layer 203 is formed, the mold 251 for the drain hole portion located at the boundary between the drain hole portion 204 and the impermeable layer 203 is removed (see FIG. 13D). The water retentive layer 202 and the pavement layer 201 are then formed on the impermeable layer 203 similarly to the first embodiment (see FIG. 13E).

Described with reference to FIGS. 14A to 14F is the operation of storing liquid in the water storage structure 210 according to the second embodiment.

Exemplified is a case where rainwater due to torrential rain or guerrilla heavy rain is supplied to the water storage structure 210. In this example, rainwater of an amount exceeding the capacity of the water storage structure 210 is supplied and the rainwater thus passes through (breaks) the impermeable layer 203. FIGS. 14A to 14F show the states changed in chronological order.

<FIG. 14A>

Water supplied onto the surface of the pavement layer 201 passes through the pavement layer 201 and is held in the water retentive layer 202.

If water of an amount exceeding the holding capacity of the water retentive layer 202 is supplied to the water storage structure 210, the water does not pass through the impermeable layer 203 but is stored in the pavement layer 201 because both of the impermeable layer 203 and the drain hole portion 204 have hydrophobicity. The length from the surfaces at which the water retentive layer 202 and the impermeable layer 203 are in contact with each other to the water surface is referred to as "depth of water" in this case.

The pavement layer 201 absorbs the water in the water retentive layer 202 so as to reach the surface of the pavement layer 201. The surface of the pavement layer 201 thus gets wet. Atmosphere temperature of the wet surface can be decreased when water contained in the wet surface evaporates.

<FIG. 14B>

Figure 14A:
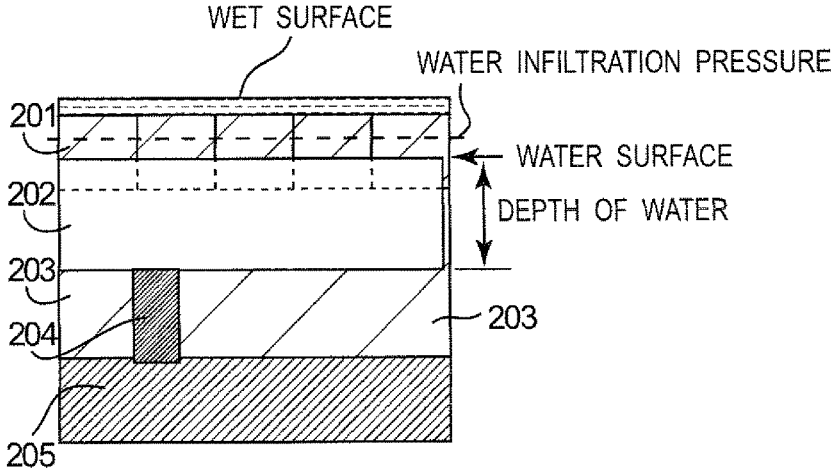
FIG. 14A is a longitudinal sectional view showing a flow of water in the water storage structure according to the second embodiment.
Figure 14B:
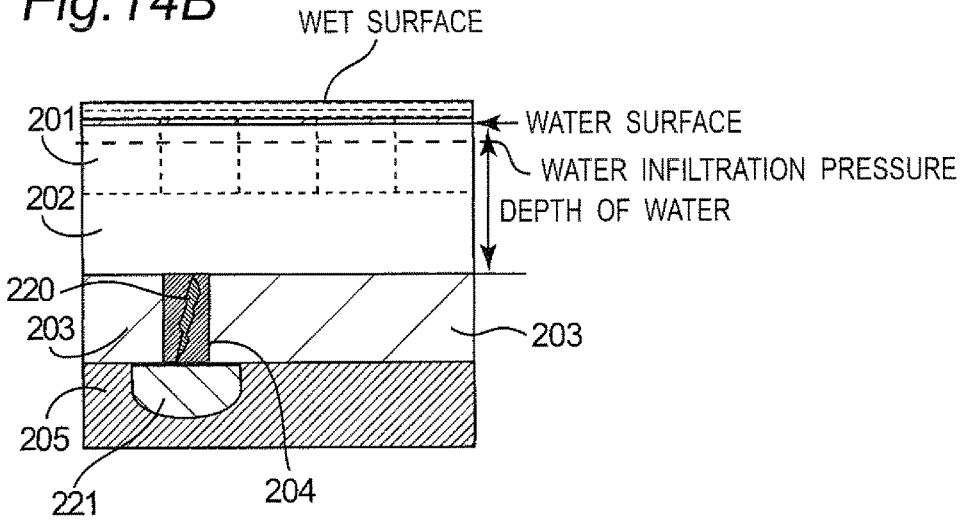
FIG. 14B is a longitudinal sectional view showing a flow of water in the water storage structure according to the second embodiment.
Figure 14C:
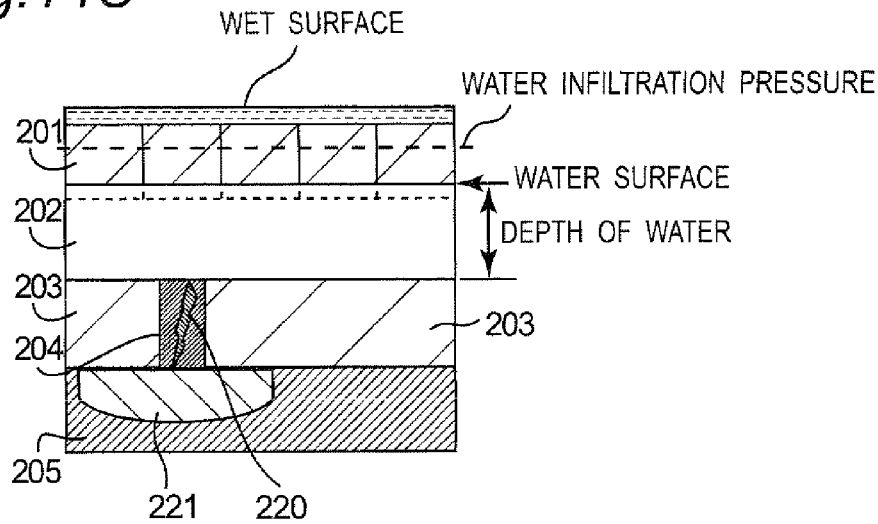
FIG. 14C is a longitudinal sectional view showing a flow of water in the water storage structure according to the second embodiment.
Figure 14D:
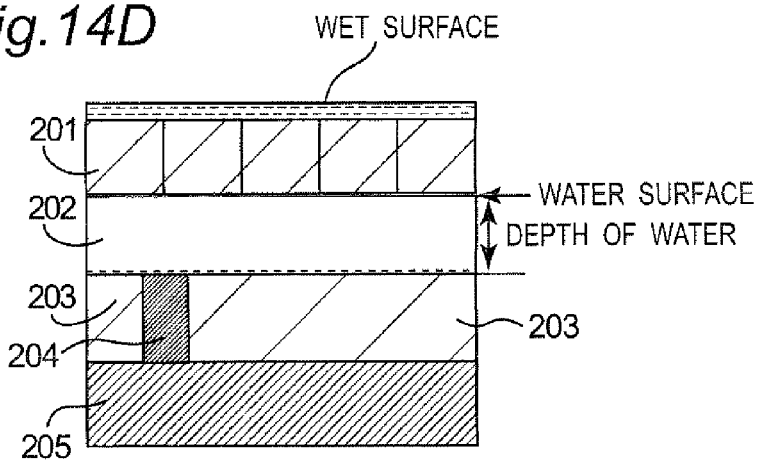
FIG. 14D is a longitudinal sectional view showing a flow of water in the water storage structure according to the second embodiment.
Figure 14E:
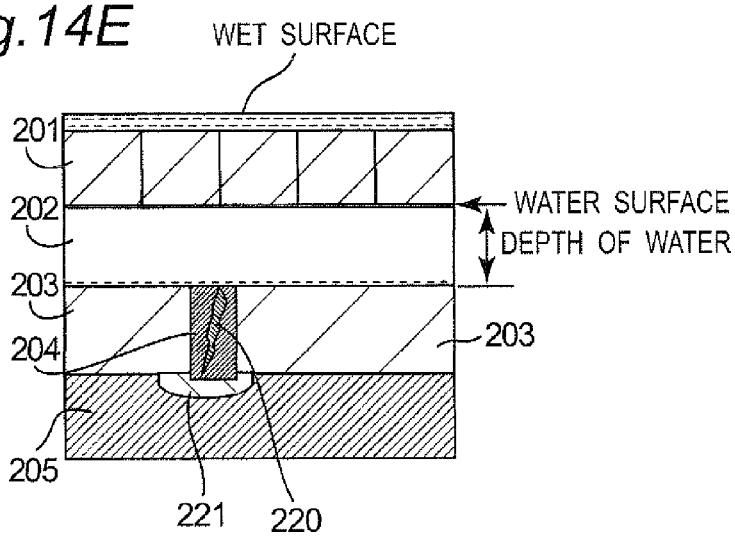
FIG. 14E is a longitudinal sectional view showing a flow of water in the water storage structure according to the second embodiment.

If pressure corresponding to the amount of water stored in the pavement layer 201 and the water retentive layer 202 exceeds the degree of the water infiltration pressure of the drain hole portion 204, the drain hole portion 204 is broken (see reference sign 220 in FIG. 14B). After the drain hole portion 204 is broken, the water stored in the pavement layer 201 and the water retentive layer 202 passes through the drain hole portion 204 and flows into the on-site soil 205 (see the portion of the on-site soil 205 containing water as denoted by reference sign 221 in FIG. 14B). The passage of water through the drain hole portion 204 is referred to as "drainage". The portion through which water flows due to the breakage of drain hole portion 204 is referred to as the "broken portion" (see the portion denoted by reference sign 220 in FIG. 14B).

When water flows into the on-site soil 205, the storing speed of water stored in the pavement layer 201 and the water retentive layer 202 is decreased dependently on the relationship with the water supplied to the pavement layer 201. Otherwise, the water surface starts to fall along with decrease in depth of water.

<FIG. 14C>

If water is continuously drained through the drain hole portion 204, downward drainage through the broken portion 220 does not stop even if the depth of water decreases and the pressure is reduced to be equal to or less than the water infiltration pressure. The water surface further falls and water is drained until the water retentive layer 202 has a holdable water amount ratio. Hereinafter, the holdable water amount ratio is also referred to as the "optimum water content ratio". The holdable water amount ratio means the ratio between the volume of the gaps in the water retentive layer 202 and the volume of holdable water, and is also referred to as the optimum water content ratio.

<FIG. 14D>

Drainage through the impermeable layer 203 stops if the amount of water contained in the water retentive layer 202 has a ratio substantially equal to the optimum water content ratio. For example, the water repellent Toyoura sand in the impermeable layer 203 has the optimum water content ratio of about 16%. The pavement layer 201 continuously absorbs the water contained in the water retentive layer 202 so as to reach the surface of the pavement layer 201 until the water has a ratio smaller than the optimum water content ratio, so that the surface of the pavement layer 201 can be kept wet.

<FIG. 14E>

Even if water flowing through the drain hole portion 204 once stops, the drain hole portion 204 is likely to be broken again. The broken portion 220 corresponds to a path through which water has passed. Hereinafter, the path through which water has passed is also referred to as a "water path".

As long as water remains in the water path, the water path tends to allow water supplied to the drain hole portion 204 to pass therethrough again. In other words, breakage is possibly caused again even in a case where the amount of water contained in the pavement layer 201 and the water retentive layer 202 is less than the amount of water applying pressure equal to or less than the water infiltration pressure. Even if water is supplied to the pavement layer 201, the supplied water is not stored in the pavement layer 201 initially supplied thereto or in the water retentive layer 202 but is possibly drained through the drain hole portion 204.

If the broken portion 220 in the water repellent sand layer 204 is dried, the pavement layer 201 and the water retentive layer 202 are again capable of storing water. In this configuration, water is stored again after the water repellent sand layer gets dried, while the water stored in the water retentive layer keeps the surface wet.

In the relationship between the time necessary for drying the drain hole portion 204 and the time necessary for reaching the water amount lower limit value at which water can be supplied to the surface of the water retentive layer 202, if the former is shorter, the surface can be constantly kept by supplying water again.

<FIG. 14F>

When the broken portion 220 is dried, the drain hole portion 204 is capable of causing the pavement layer 201 and the water retentive layer 202 to store water up to the height corresponding to the water infiltration pressure. FIG. 15 indicates change in water infiltration pressure obtained by repetitively performing trial in which water having a pressure equal to or more than the water infiltration pressure is supplied to a water repellent sand layer including the sea sand processed by water repellent treatment so as to pass through the water repellent sand layer, the water repellent sand layer is then dried until the portion that has allowed water to pass therethrough gets dried, and the water infiltration pressure of the dried water repellent sand layer is measured. The chart indicates the number of times of the passage of water and the water infiltration pressure after the water repellent sand layer is dried. It is found from the chart that the water infiltration pressure after the first supply is kept even after the trial is repeated for 50 times, and the water infiltration pressure recovers to the original degree when the water repellent sand layer once allowed passage of water is dried.

Similarly to the water storage structure according to the first embodiment, the water storage structure 210 according to the second embodiment holds liquid in the water retentive layer 202 and the pavement layer 201 when liquid of a constant amount or less is supplied, so that the surface of the pavement layer 201 can be kept wet. The drain hole portion 204 is broken when liquid of the constant amount or more is supplied. Accordingly, even if an excessive amount of liquid is supplied, it is possible to prevent the problems that the liquid overflows from the surface of the pavement layer 201 to a different portion and the water storage structure 210 deteriorates in strength.

Furthermore, provision of the drain hole portion 204 enables the location of breakage to be intentionally specified at the drain hole portion 204. There is no need of trouble or time for drying the entire impermeable layer in a case where the location of breakage is dried or where it is necessary to adjust the amount of stored water due to change in climate such as rainfall of an unexpected large amount. It is possible to easily store water of a planned amount by drying only partially the drain hole portion 204 or modifying only the conditions of the water repellent sand in the drain hole portion 204 (such as the particle diameters or the mixture ratio with sand with no water repellency).

Though the present disclosure has been described above based on the above first to second embodiments and modification examples, the present disclosure should not be limited to the above-described first to second embodiments and modification examples. For example, the present disclosure also includes the following cases.

By properly combining the arbitrary embodiment(s) or modification(s) of the aforementioned various embodiments and modifications, the effects possessed by the embodiment(s) or modification(s) can be produced.

INDUSTRIAL APPLICABILITY

The water storage structure according to the present disclosure is useful in a road, a sidewalk, a rooftop greening system, or the like.

The entire disclosure of Japanese Patent Application No. 2011-267974 filed on Dec. 7, 2011, including specification, claims, drawings, and summary are incorporated herein by reference in its entirety.

Although the present invention has been fully described in connection with the embodiments thereof with reference to the accompanying drawings, it is to be noted that various changes and modifications are apparent to those skilled in the art. Such changes and modifications are to be understood as included within the scope of the present disclosure as defined by the appended claims unless they depart therefrom.

The invention claimed is:

1. A water storage structure comprising:

an impermeable layer including a plurality of hydrophobic particles;

a water retentive layer provided on the impermeable layer and capable of holding a predetermined volume of liquid; and a pavement layer provided on the water retentive layer and including a tube penetrating from a first surface of the pavement layer to a second surface of the pavement layer, wherein the impermeable layer has a water infiltration pressure threshold, when a liquid is applied to the impermeable layer, a water pressure, corresponding to a thickness of the pavement layer and a thickness of the water retentive layer, is applied to the impermeable layer, when the water pressure is equal to or less than the water infiltration pressure threshold of the impermeable layer, the impermeable layer is capable of holding the liquid, such that the liquid does not pass through the impermeable layer, and when the water pressure is greater than the water infiltration pressure threshold of the impermeable layer, the impermeable layer is capable of breaking, such that the liquid passes through a broken portion in the impermeable layer.

2. The water storage structure according to claim 1, wherein the hydrophobic particles have surfaces processed by water repellent treatment with a material of a chlorosilane system or a material of an alkoxysilane system.

3. The water storage structure according to claim 2, wherein the pavement layer is provided therein with gaps continuously connected to each other, such that the pavement layer absorbs the liquid from a bottom surface to a top surface of the pavement layer, the liquid comprising water.

4. The water storage structure according to claim 2, wherein the tube of the pavement layer causes the liquid to be conveyed by a capillary phenomenon.

5. The water storage structure according to claim 1, wherein the water retentive layer includes an aggregation of hydrophilic particles or particles having surfaces covered with a hydrophilic material, and has a gap between adjacent particles of the aggregation of hydrophilic particles or adjacent particles of the particles having surfaces covered with a hydrophilic material.

6. The water storage structure according to claim 5, wherein the pavement layer is provided therein with gaps continuously connected to each other, such that the pavement layer absorbs the liquid from a bottom surface to a top surface of the pavement layer, the liquid comprising water.

7. The water storage structure according to claim 5, wherein the tube of the pavement layer causes the liquid to be conveyed by a capillary phenomenon.

8. The water storage structure according to claim 1, further comprising:

a drain hole portion that is equal in thickness to the impermeable layer and includes a water repellent sand layer having a water infiltration pressure threshold lower than that of the impermeable layer, the water repellant sand layer having a thickness equal to that of the impermeable layer.

9. The water storage structure according to claim 8, wherein the pavement layer is provided therein with gaps continuously connected to each other, such that the pavement layer absorbs the liquid from a bottom surface to a top surface of the pavement layer, the liquid comprising water.

10. The water storage structure according to claim 8, wherein the tube of the pavement layer causes the liquid to be conveyed by a capillary phenomenon.

11. The water storage structure according to claim 8, wherein the drain hole portion is formed only in the impermeable layer, and the tube is formed only in the pavement layer.

12. The water storage structure according to claim 8, wherein in breaking the impermeable layer, the broken portion is located in the drain hole portion.

13. The water storage structure according to claim 1, wherein the pavement layer is provided therein with gaps continuously connected to each other, such that the pavement layer absorbs the liquid from a bottom surface to a top surface of the pavement layer, the liquid comprising water.

14. The water storage structure according to claim 1, wherein the tube of the pavement layer causes the liquid to be conveyed by a capillary phenomenon.

15. The water storage structure according to claim 1, wherein the pavement layer includes a through hole where the pavement layer is not provided on the water retentive layer.

16. The water storage structure according to claim 15, wherein the through hole is capable of holding a portion of the liquid applied to the impermeable layer.

17. The water storage structure according to claim 1, wherein the pavement layer includes an aggregation of a plurality of particles, and the tube has an inner diameter based on diameters of particles of the plurality of particles.

* * * * *